United States Patent [19]

Bice

[11] 4,220,837

[45] Sep. 2, 1980

[54] BI-SWITCH CONSTRUCTION HAVING AN AUXILIARY INTERRUPTING DEVICE ASSOCIATED THEREWITH

[75] Inventor: Charles D. Bice, Pittsburgh, Pa.

[73] Assignee: Westinghouse Electric Corp., Pittsburgh, Pa.

[21] Appl. No.: 757,421

[22] Filed: Jan. 6, 1977

Related U.S. Application Data

[63] Continuation of Ser. No. 547,845, Feb. 6, 1975, abandoned, which is a continuation of Ser. No. 284,520, Aug. 28, 1972, abandoned.

[51] Int. Cl.[2] ..... H01H 33/12

[52] U.S. Cl. ..... 200/146 R; 200/144 B; 200/153 J; 200/153 G

[58] Field of Search ..... 200/146 R, 153 J, 153 G, 200/144 B

[56] References Cited

U.S. PATENT DOCUMENTS

| | | | |
|---|---|---|---|
| 2,480,622 | 8/1949 | Warnock | 200/146 R |
| 3,070,680 | 12/1962 | McBride et al. | 200/146 R |
| 3,234,803 | 2/1966 | Caswell et al. | 200/153 G |
| 3,308,259 | 3/1967 | Hulteen et al. | 200/146 R |
| 3,482,192 | 12/1969 | Walker | 200/153 J |
| 3,571,543 | 3/1971 | Perkins et al. | 200/146 R |
| 3,601,565 | 8/1971 | Few | 200/153 G |

*Primary Examiner*—Robert S. Macon
*Attorney, Agent, or Firm*—Robert E. Converse, Jr.

[57] ABSTRACT

An improved bi-switch construction is provided having an interrupting device arranged in electrical parallel relation therewith so that the circuit through each of the two switches is made through the interrupting device, and, subsequently, the interrupting device is shorted out in the closed-circuit position of the particular switch being operated. During the opening operation, again the interrupting device is brought into play so that a parallel electrical path is provided in shunt relationship to the particular switch being operated through the interrupting device, the interrupting switch assuming the burden of interrupting the circuit; and subsequently the particular switch being operated provides an isolating gap from the interrupting device.

The arrangement is particularly desirable when two three-phase switches have a common leg, or terminal, to which one end of the interrupting device may be electrically attached, so that either switch may be operated with the interrupting device serving as a common means for both switches.

An improved overcenter spring mechanism is provided for operating the interrupting device in both the closing direction and also in the opening direction for quick-make and quick-break operations of the interrupting device.

In one arrangement, the movable contact member of each switch may comprise a rotatable movable blade, which first makes contact with an auxiliary terminal of the interrupting device, while simultaneously the overcenter spring device of the mechanism for operating the interrupting device is being charged. Further rotational movement of the movable rotatable blade of the particular switch effects, through the overcenter spring device, quick closing of the interrupting device, and further rotation of the movable blade effects a bypassing of the interrupting device, so that in the closed position of the particular switch being operated the interrupting blade effects conduction of all of the current to the main terminals of the particular switch being operated to the exclusion of the interrupting device.

47 Claims, 39 Drawing Figures

BI-SWITCH CONSTRUCTION HAVING AN AUXILIARY INTERRUPTING DEVICE ASSOCIATED THEREWITH

CROSS REFERENCES TO RELATED APPLICATIONS

This is a continuation of application Ser. No. 547,845 filed Feb. 6, 1975, now abandoned, which is a continuation of application Ser. No. 284,520, filed Aug. 28, 1972, now abandoned.

Applicant is not aware of any other related applications pertinent to the present invention.

BACKGROUND OF THE INVENTION

Important current developments in underground distribution include everything from product modifications to totally new products. Not only are systems being changed to achieve optimization and better functioning, but also, totally new systems are being tried. In addition, the commercial policies of utilities with regard to providing underground facilities, particularly underground main feeders and overhead-to-underground conversion, are areas of considerable significance.

Much of the desire for underground three-phase main feeders is caused by the unacceptable appearance of overhead main feeders, that must be located in areas served by single-phase underground circuits. Main thoroughfares through suburban areas also present a growing need for underground three-phase feeders to improve appearance.

The unacceptable appearance, in some areas, of a pad-mounted transformer on a front lot line has increased the desirability of a unit residential transformer, that can be located next to a home. Growing loads, long subdivision construction periods, and high interest rates are combining to make the URT systems more practical, particularly when the benefits of deferred investment are evaluated.

Underground switching and protection have assumed ever-increasing importance. Until recently, the requirement for an underground three-phase switching and protective device has been rather vaguely described as a device that permits, for example, the tapping of a 200-ampere underground lateral circuit to a 600-ampere underground main feeder, and providing for adequate switching and fault protection. In response to a considerable need for such a device, development work has resulted in an analysis of the functional requirements for underground three-phase switching and protective equipment. Results of considerable study indicate that with very little increase in total feeder cost, a significant improvement in total utility customer outage time can be achieved by the extensive use of main feeder tap switches, which may include multiple fused lateral tap capability. This improvement in reliability is much greater than one might expect from the use of main-line sectionalizing devices. The essential reasons for the reliability improvement are the combined effects of main-line sectionalizing, with multiple lateral tapping at the sectionalizing point. The ultimate end result with all laterals connected to the switches is that no utility customer will be cut of service for a min-lined fault any longer than it takes to locate the fault and perform the necessary switching operation. This same basic approach can be extended even further by the judicious looping of the underground lateral circuits themselves, so that each lateral circuit is served by two different main feeder devices. It is, therefore, desirable to provide pad-mounted and submersible three-phase switches, which meet the desired foregoing functional specifications.

As well known by those skilled in the art, in certain classes of switchgear and circuit breakers, the use of vacuum "bottles," or vacuum interrupters is desirable. The advantages of the "bottles" include reliability, small size, short operating stroke, and quiet operation. Disadvantages of the use of vacuum "bottles" in switchgear and circuit breakers are the high cost, and there being no visible open gap when the circuit within the vacuum interrupter is opened.

Particularly important in the use of vacuum switching is the attainment of a visible break employed in both commercial versions of the bi-switch arrangement of the present invention, namely the pad-mounted version and also the submersible version of the switch. For example, both of the models provide, a 600-ampere gang-operated three-phase switch on the incoming side, and a similar switch on the outgoing side. Preferably, the pad-mounted unit should be relatively low in height, for example, 35 inches high. Additionally, the submersible unit should be operated from the top of the unit with all parts integral to the stainless steel lid, when such a metal cover is provided for maintenance purposes.

The advantages of the unit-residential-transformer concept, or one transformer per house, include increased flexibility in handling wide ranges of loads, an economic advantage of deferred transformer investment, until the house is actually under construction, improved appearance compared to a large pad-mounted transformer situated on the front lot line, and the elimination of most secondary conductors.

Apparent disadvantages include the need for more primary cable and loss of load diversity, which implies the need for greater transformer capacity. It is apparent that the loss of diversity situation can best be handled by designing a special transformer for URT application, that is capable of carrying the short term, relatively high-peak load of an individual residence, rather than attempting to adapt a conventional transformer, that originally was designed to serve a number of homes, rather than one home. Reliability studies have indicated that the best method of connecting the URT to the primary lateral circuit is by means of a fused "T"-Tap device located at the point of connection to the primary lateral cable. The radial primary service from the lateral to the transformer is connected to the primary lateral through, for example, a drawout current-limiting fuse.

Results of economic study of URT application show that the combinations of load demand, deferment period, and lot width, which result in the URT being more economical than any pad-mounted transformer-secondary system, and also any submersible transformer-secondary system. Compared to a pad-mounted transformer-secondary system, the URT appears to be economical for high loads, large lots and long deferment periods, as might be characteristic in a fairly expensive neighborhood. On the other hand, one of the main features of the URT system is improved appearance over a front-lot-line pad-mounted system. If the front-lot-line pad-mounted transformer is unacceptable, than one alternative is to use a submersible transformer-secondary system. The URT system, compared to the submersible transformer-secondary system, is quite feasible. In this case, it would seem that many high-usage homes on large lots could be served economically by a URT system, if the deferment period is four or five years or more.

As a result of an extensive survey of new-product requests by nineteen utilities and three utility groups, the latter involving 37 other utilities, such a detailed survey resulted in the following requested resultant specifications:

| Resultant Specifications | |
|---|---|
| Continuous Current | 600a 30, 200a 10 |
| Momentary | 20,000a 30, 12,000a 10 |
| BIL | 95 KV |
| Size | Vault-mounted; low profile pad |
| 36 Switches | 2 required (in and out) |
| 10 Taps | 3 or 6 solid, switched or fused |
| Fuse Rating | 30a to 130a |
| Fuse Type | Current-Limiting |
| Enclosure | Submersible-non-corrosive<br>Pad mounted-mild steel |
| Operation of Switch | Manual, with a visible break |

As far as I am aware, the prior art has utilized vacuum "bottles" or vacuum interrupters as switches to open and close the circuit, with the vacuum interrupters carrying the continuous current through such switching devices. In addition, where two switches have a common point for a tap connection, each of the switches was provided with its own separate vacuum interrupter unrelated to the vacuum interrupter of the other switch. Accordingly, it would be desirable to halve or drastically reduce the number of vacuum "bottles" required, and consequently to enable two such switches to use the same vacuum "bottles" or interrupters to reduce cost and size of the equipment.

In addition, as far as I am aware, the prior art does not show the use of a switch such as the movable-blade variety, using an auxiliary interrupting device for making or breaking the associated circuit. It would be desirable to make and break the associated circuit on the auxiliary interrupting device, which might be arranged for a lower rating than that, which would be required if the interrupting device were in the series circuit itself.

Moreover, the use of a snap-acting quick-make and quick-break mechanism, associated with the auxiliary interrupting device, would be desirable to minimize prestriking during the closing stroke of the device and thereby reduce the duty imposed upon the switch contacts, and by a quick-break, a fast and effective interruption of the resulting arc could be accomplished during the opening operation of the switch.

SUMMARY OF THE INVENTION

In accordance with preferred embodiments of the present invention, a bi-switch device is provided having associated therewith an auxiliary interrupting device, which provides a quick-make and a quick-break of the circuit. The interrupting device may assume different forms, either oil, gas-generating, or the vacuum-"bottle," or vacuum-interrupter variety, since the latter is compact, highly reliable and requires very little contact stroke.

The improved bi-switching device of the present invention involves, in one particular form, two switches, such as three-phase switches, which have a common leg, or terminal. Preferably, the interrupting device has one end in fixed attachment or, at least, electrical connection to the common leg, or terminal of the two switches. The other end of the interrupting device may selectively be electrically connected to either of the two associated switches as desired. Moreover, preferably, the improved bi-switching device of the present invention utilizes a quick-make and quick-break snap-acting mechanism, which provides for a quick-make and quick-break of the separable contacts within the interrupting device, such, for example, as a vacuum "bottle". The blade-moving action of the main blade of each of the two switching devices may be utilized to charge the overcenter-spring mechanism of the interrupters to thereby result in a quick-make and a quick-break of the separable contacts of the associated interrupting device.

The improved bi-switching device of my invention may assume many forms, for example, a pad-mounted version, or a submersible type, which is placed deep in the ground and manually operated by an operator from above the equipment.

In addition, the bi-switching equipment of the present invention contemplates that the operation of one of the two common switches prevents, by an interlocking arrangement, the operation of the other associated switch at the same time.

Accordingly, it is a general object of the present invention to provide an improved bi-switching device, which has associated therewith another interrupting device of at least some interrupting capability.

Still a further object of the present invention is the provision of an improved bi-switch device of the moving-blade type, in which an auxiliary interrupting device is associated to make and break the circuit through the aforesaid bi-switching device.

Another object of the present invention is the provision of an improved bi-switching device having a vacuum-bottle interrupting device associated therewith, which assumes the burden of making and breaking the circuit through the bi-switching device.

Another object of the present invention is the association of two switches having a common leg or terminal, the latter being electrically connected to one end of an interrupting device with the other end of said interrupting device capable of selectively making electrical engagement with the other terminal of each of the associated two switching devices.

Another object of the invention is to provide an improved switching utilizing for interruption a vacuum-interrupter in which the switch has a movable contact member which separates from one of the terminals of the vacuum-interrupter, a d window means provided so that operating personnel may look through the window of the enclosure, and determine whether or not the isolating break is in existence.

Another object of the invention is to provide an improved operating mechanism for a circuit interrupter.

Still a further object of the present invention is the provision of an improved overcenter toggle mechanism for a circuit interrupter.

An ancillary object of the invention is to provide an improved quick-make and quick-break operating mechanism for a circuit interrupter utilizing as the initiating means a rotary contact-operating member.

Still a further object of the invention is the provision of an improved bi-switch operating equipment in which the component parts thereof are disposed in an advantageous compact arrangement within the equipment, so that a minimum of actuating movement is required to cause operation of the switch.

Another object of the invention is the provision of an improved disconnecting switch having an interrupting unit associated therewith, and brought into the circuit only during an intermediate portion of the opening and closing operations.

Still a further object of the invention is to provide an improved device of the type specified in the immediately preceding paragraph in which a quick-make and quick-break toggle-operating mechanism is associated with the interrupting device.

Still a further object of the present invention is the provision of an improved quick-make and quick-break operating mechanism to be used with a switching device of the type proposed hereinbefore or, perhaps, for use only with a single switch.

Another object of the present invention is the provision of an improved quick-make and quick-break operating mechanism, which is actuated in accordance with the movement of the movable blade of either of the two switching devices.

Another object of the present invention is the provision of two switches having the common use of vacuum bottles, so that the number of vacuum bottles required is reduced or halved in number.

Still a further object of the present invention is the provision of an improved manually-operable "T"-type switching construction, in which each of the two switches may be manually operated to the exclusion of the other associated switch by a novel mechanical interlocking arrangement.

Still a further object of the present invention is the provision of an improved quick-make and quick-break operating mechanism for any type of switching device.

Still another object of the present invention is the provision of an improved "T"-type switching device, which is suitable for either submersible environments or for pad-mounted environments.

Further objects and advantages will readily become apparent upon reading the following specification, taken in conjunction with the drawings.

DESCRIPTION OF THE PREFERRED EMBODIMENTS

Figure 1:
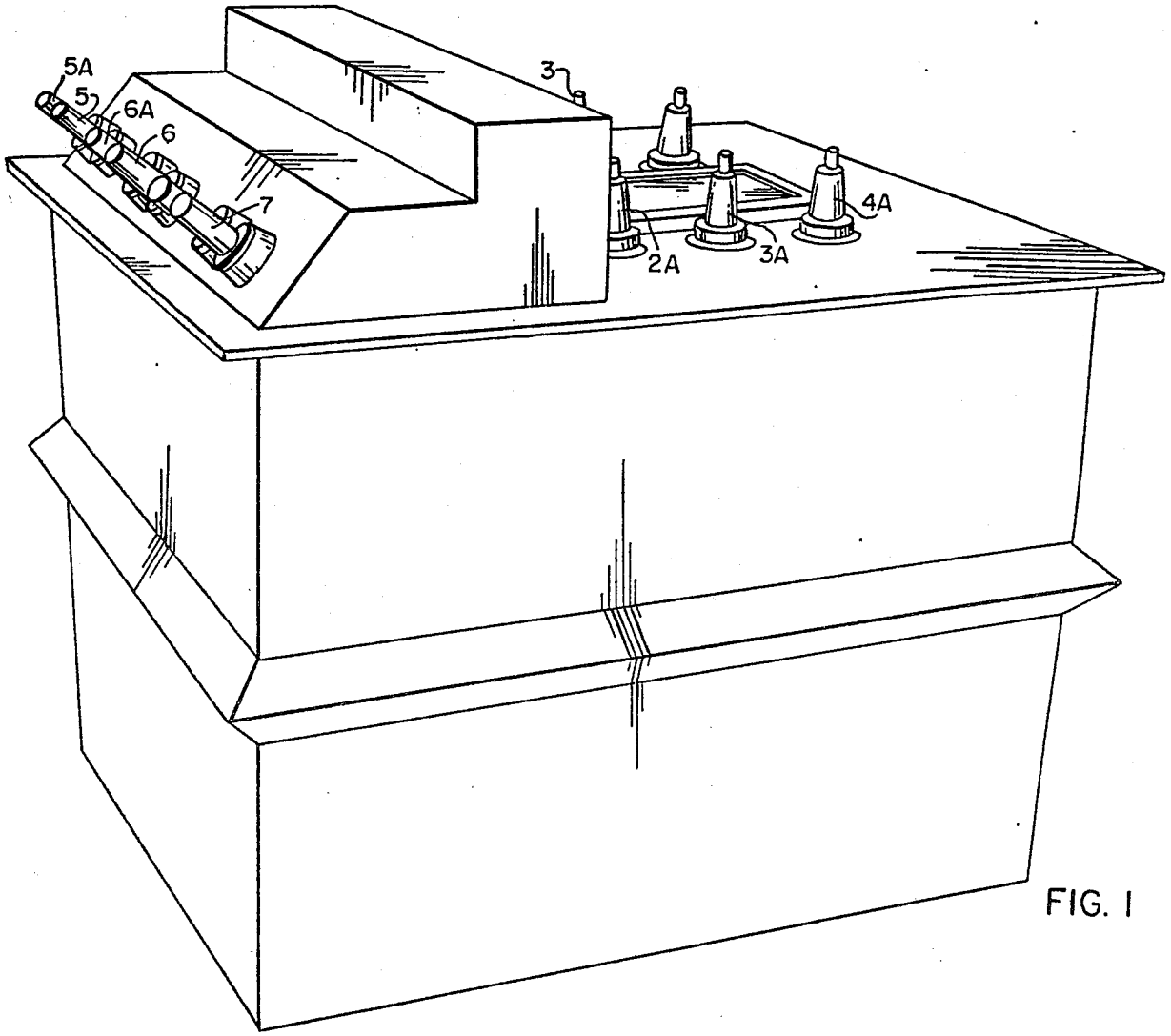
FIG. 1 is a perspective view of an submersible type of bi-switch device embodying the features of the present invention.
Figure 15:
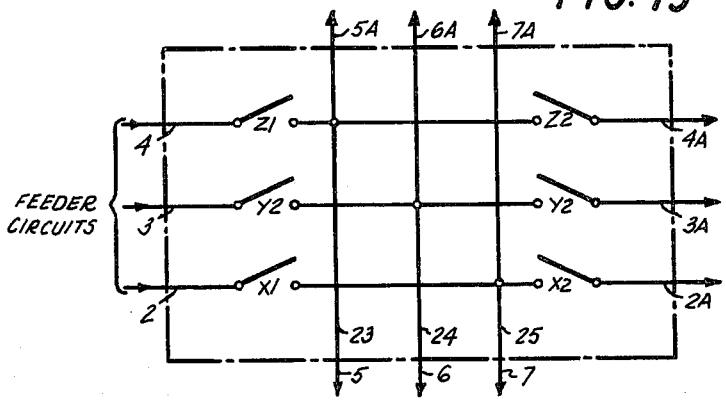
FIG. 15 is a diagrammatic view of the feeder switch connection showing an incoming feeder connected to an outgoing feeder, together with single-phase tapoff laterals, or possibly three-phase tap offs.

Referring to the drawings, and more particularly to FIG. 1 thereof, the reference numeral 1 generally designates the "T" bi-switch construction of the present invention. In the particular version of the switch shown in FIg. 1, the switch is adaptable for submersible applications, where it is positioned in a vault down in the ground, and manually operated from above. Generally there are provided two sets of incoming and outgoing feederterminals 2, 3, 4, 2A, 3A, 4A, and additional terminals 5, 6, and 7 for lateral single-phase taps. As illustrated in FIG. 15, it will be apparent that three incoming feeder terminals 2, 3, 4 are provided, which connect to interrupting devices X1, Y1 and Z1, to enable connection with lateral taps, such as the lateral terminal bushings 5, 6 and 7. Additional lateral taps may be provided, such as the lateral taps 5A, 6A and 7A. The outgoing feeder terminals 2A, 3A, 4A are provided so that when the interrupting devices X1, Y1, Z1 are closed, through circuits are provided, including the incoming feeder terminals, through the interrupting devices X2, Y2, Z2, and continuing through the outgoing feeder terminal 2A, 3A and 4A.

Figure 16:
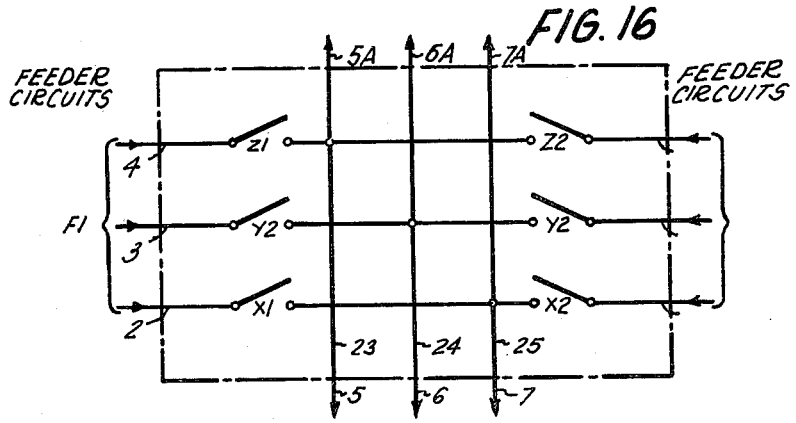
FIG. 16 is a similar diagrammatic view showing two incoming feeders and lateral outgoing tapoff laterals.

It will also be noticed that the lateral taps, which may be either single-phase laterals, of three-phase tap-offs, may be connected to the three circuits. Also, as shown in FIG. 16, two sets of incoming feeder terminals, such as the feeder terminals 2, 3, 4, 8, 9, 10, may be connected through the interrupting devices X1, Y1, Z1, X2, and Z2 to the lateral tap-offs 5, 6, 7, 5A, 6A, 7A. The lateral tap-offs may constitute single-phase lateral circuits, or, if desired, three-phase circuits. Thus selectivity is provided in FIG. 16, so that the laterals may connect with either the incoming feeder terminals 2, 3, 4, or the interrupting devices may be opened, and the lateral taps 5, 6, 7 may be connected with the other incoming feeder terminals 8, 9, 10. A versatility of switching arrangements is thereby obtained.

As will be illustrated more clearly hereinafter, the switches, which are diagrammatically shown as X1, X2, Y1, Y2, Z1, Z2 in FIGS. 15 and 16 are, in fact only one set of such devices in the structural arrangement of the invention, instead of two sets, as diagrammatically indicated in FIGS. 15 and 16. As a result, an economical reduction, or halving, of the number of interrupting devices X, Y, Z are consequently provided.

Figure 2:
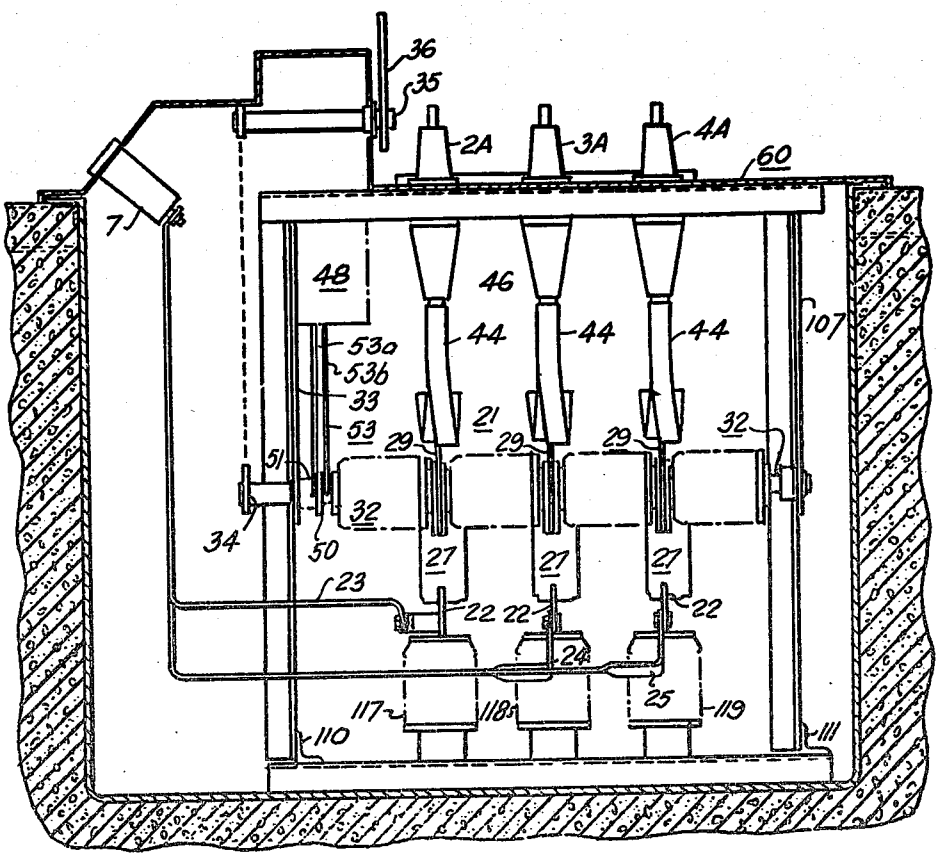
FIG. 2 is a longitudinal sectional view taken through the submersible form of the bi-switch device of FIG. 1.
Figure 3:
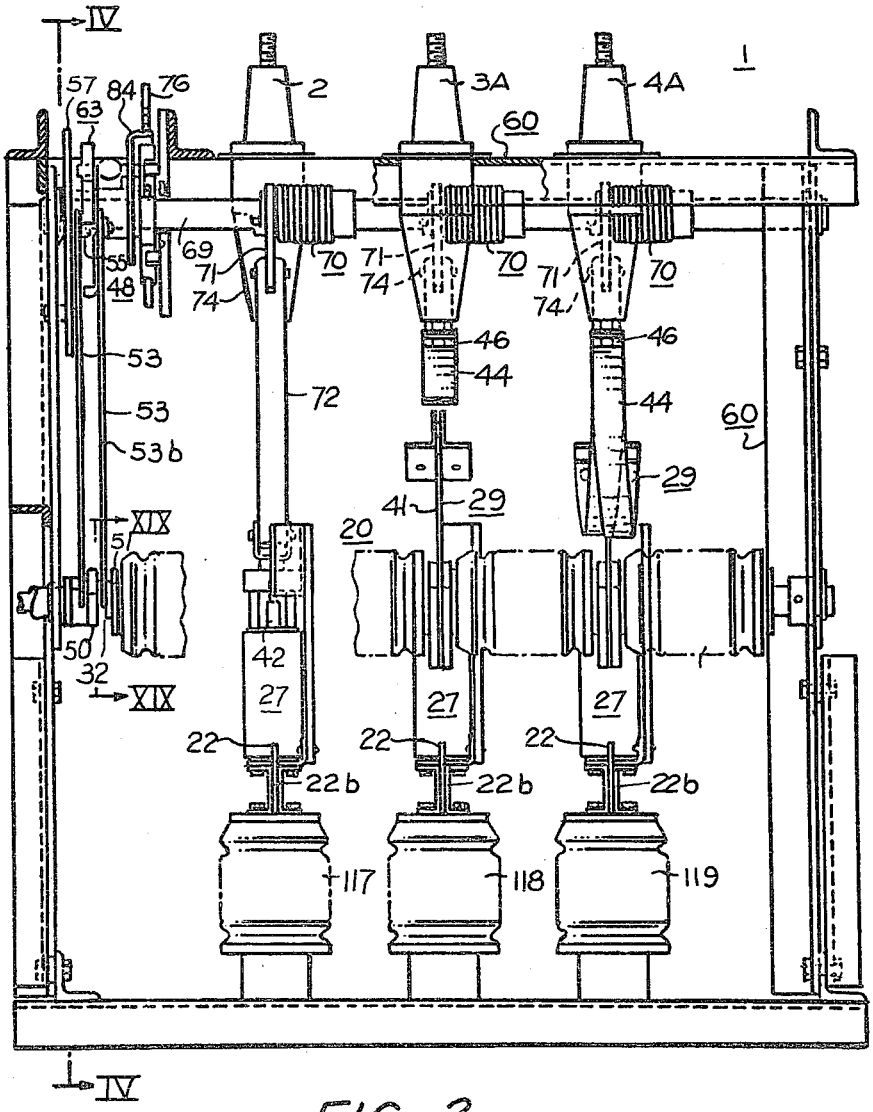
FIG. 3 is an enlarged sectional view showing more clearly the vacuum "bottles" or interrupters utilized in the improved bi-switch of the invention.
Figure 4:
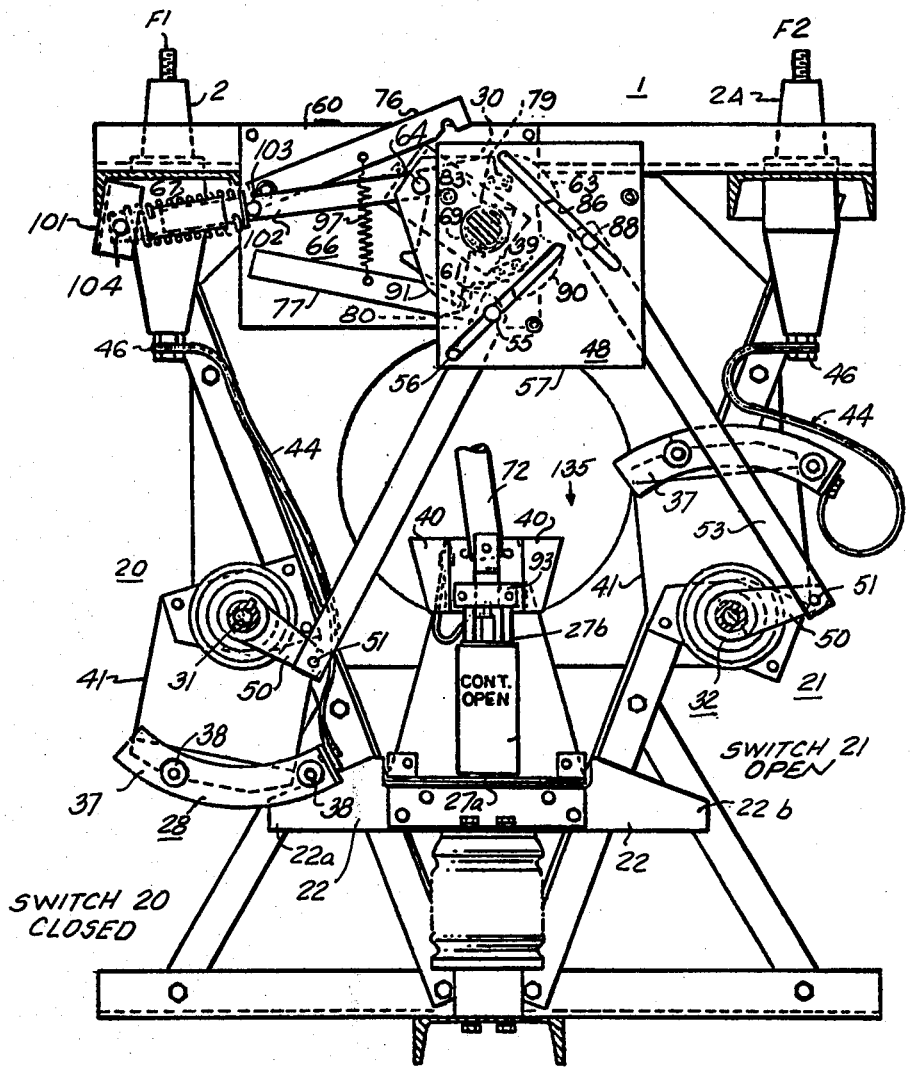
FIG. 4 is an end sectional view of the switch and the operating mechanism taken along the line IV—IV of FIG. 3 with one of the two switches in the "open" position, whereas the other associated switch is in the "closed" circuit position.

With reference to FIGS. 2, 3 and 4 of the drawings, it will be apparent that there is provided two three-phase switches, generally designated by the reference numerals 20 and 21 which have a common leg or terminal 22, to which may be tapped single-phase laterals 23, 24 and 25 (FIG. 2) for distribution circuits. Associated with one of the three-phase switches 20 are the three terminal bushings 2, 3 and 4 which, for example, may be adapted for a 600-ampere rating. The terminal bushings 5, 6, 7 for the lateral circuits, as more clearly shown in FIG. 2, may, for example, be of a lower rating, say 200-amperes. Thus, it is possible to connect the laterals 5, 6, 7 with either of the two main feeder circuits F1 or F2 (FIG. 16) which are connected to the two pairs of feeder terminals 2–4, 8–10.

In the improved switch construction 1 of the present invention, the usual number of vacuum "bottles" 27, or other interrupting devices (as described later), is halved by the conjoint use of the bottles 27 selectively with either of the two movable blade assemblies 28, 29, which are rotatively mounted upon rotatable shaft assemblies, designated by the reference numerals 31 and 32. These shaft assemblies 31, 32 are driven, in the embodiment of the invention shown in FIG. 2, by two chain drives. One (FIG. 2) chain-drive 33 connects to a sprocket wheel 34, affixed to the insulator assembly, upwardly to an operating shaft 35, which has provision for a handle 36. Thus, by a manual operation of the handle 36, keyed to the operating shaft 35, such rotary motion may be transmitted, generally by means of the chain 33, to the lower-disposed rotatable shaft assembly 31 carrying, in an insulated manner, the several rotatable blade assemblies 28. The other operating shaft assembly 32 has its own chain drive for operating the several blade assemblies 29.

Figure 5:
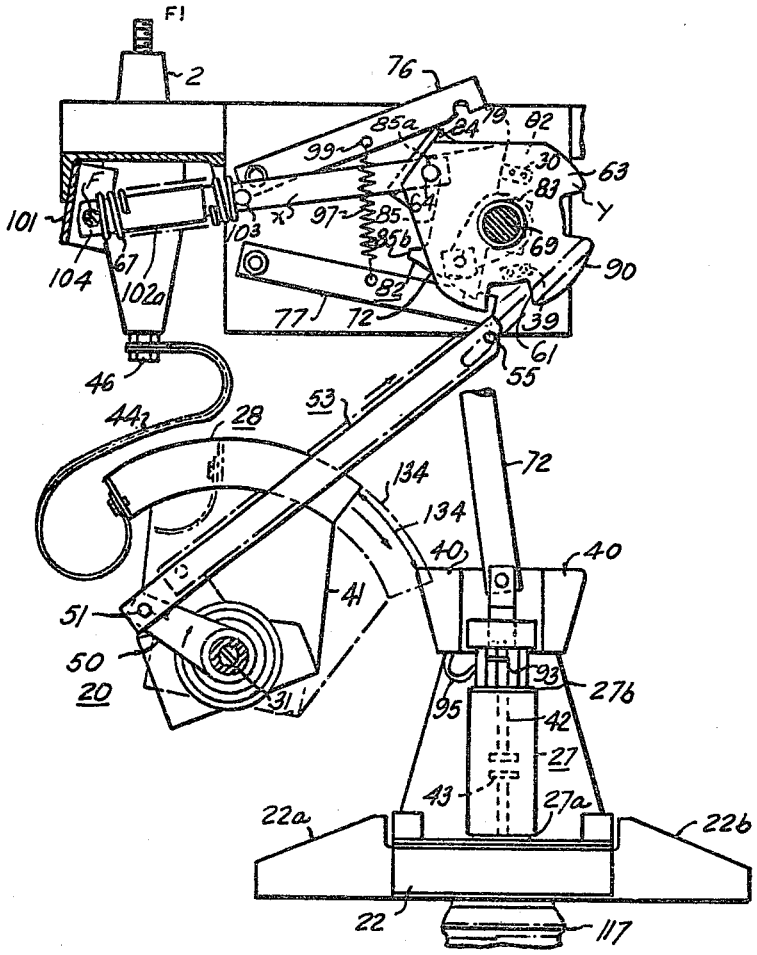
FIG. 5 is a fragmentary view showing the process of closing of one of the switches from the open position thereof.
Figure 6:
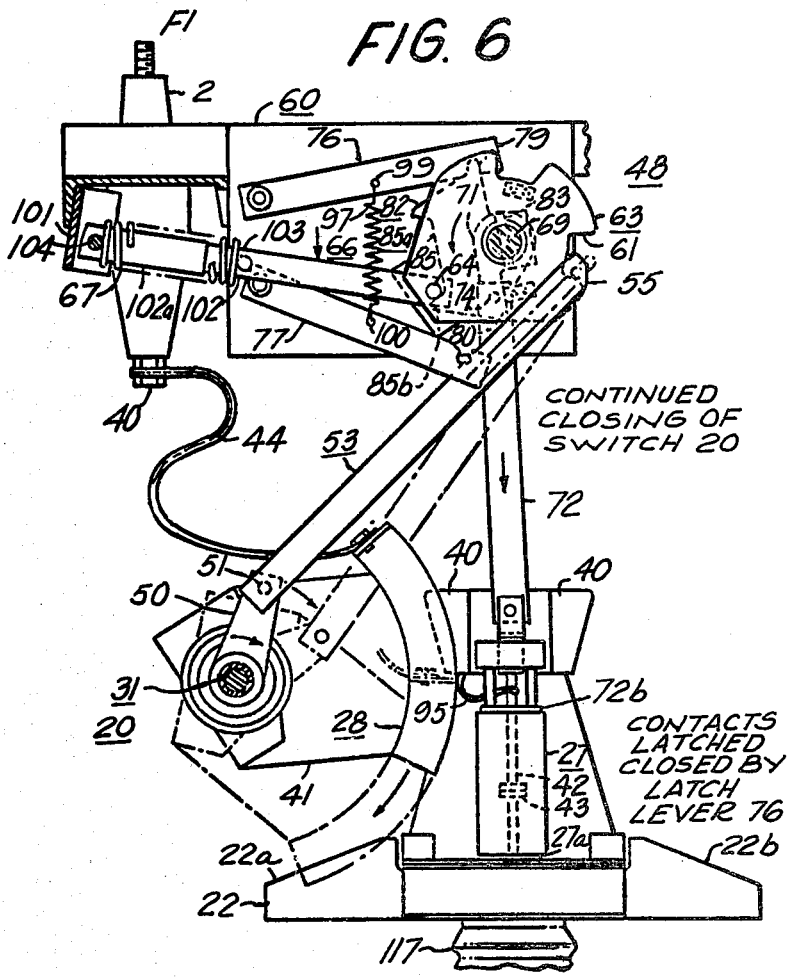
FIG. 6 is a view similar to FIG. 5, but showing a further progressive movement of the switch blade during the closing operation.
Figure 7:
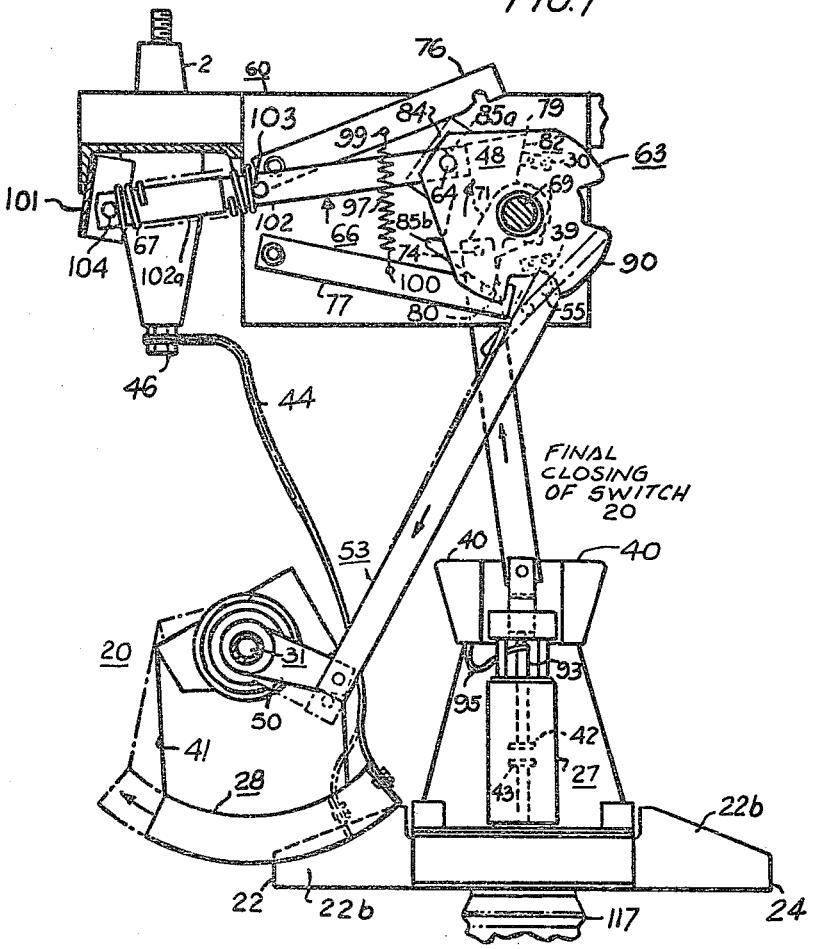
FIG. 7 is another view similar to FIGS. 5 and 6, but showing the closed position of the switch.
Figure 26:
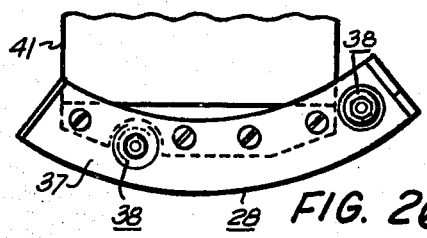
FIG. 26 illustrates fragmentarily one of the rotatable blade assemblies.
Figure 26A:
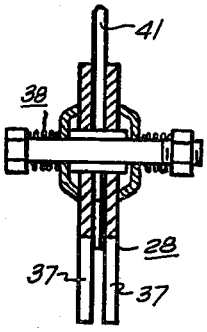
FIG. 26A is a fragmentary sectional view of the rotatable blade-assembly of FIG. 26.
Figure 28:
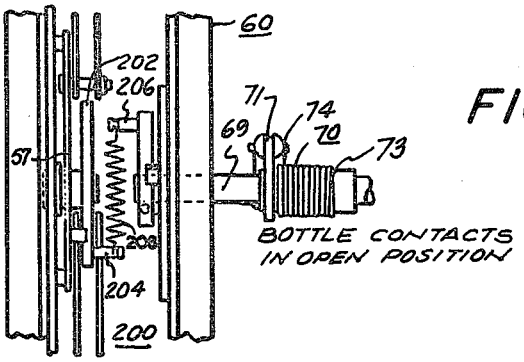
FIG. 28 is a top plan view of a fragmentary portion of the operating mechanism illustrated in FIG. 27, taken substantially along the line XX–XXVIII of FIG. 27.
Figure 27:
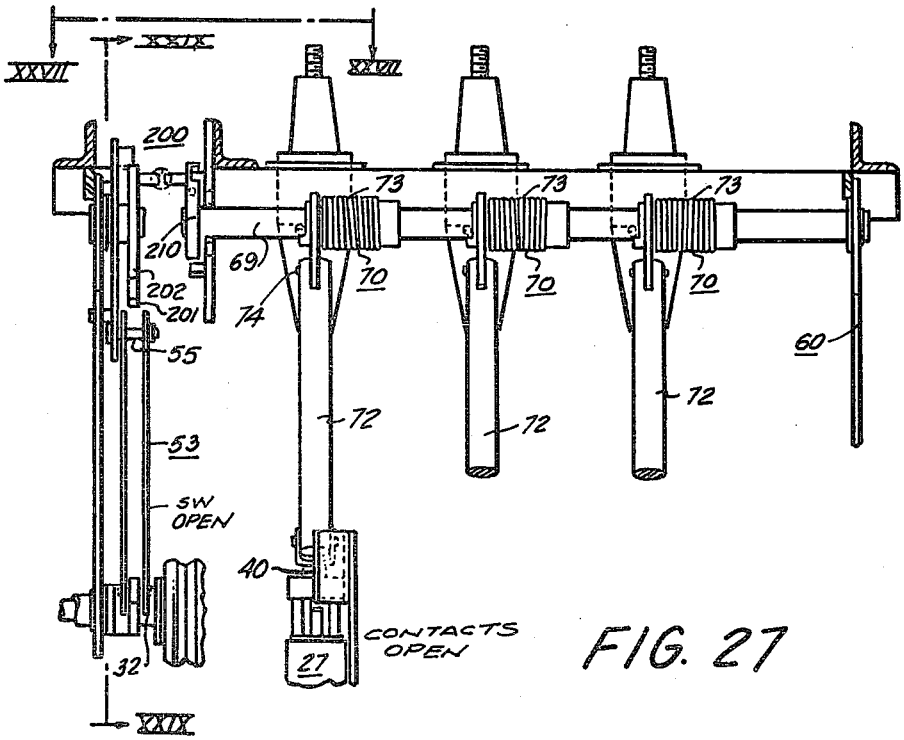
FIG. 27 is a modified-type of overcenter operating mechanism, which may be substituted in place of that illustrated in FIGS. 4–8 of the drawings, the device being illustrated in the closed-circuit position.
Figure 29:
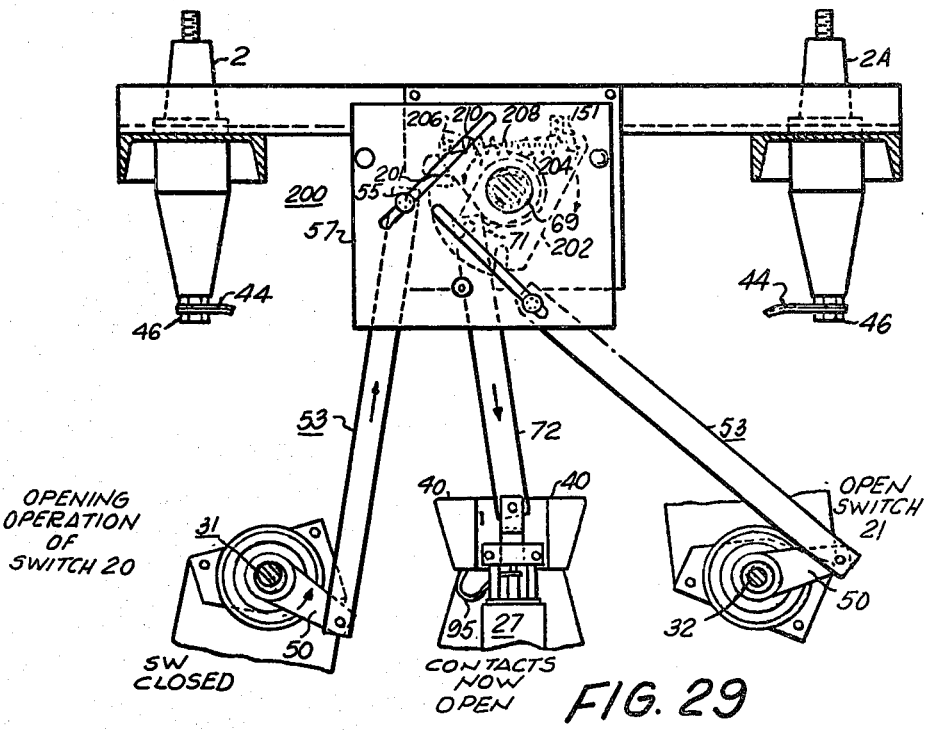
FIG. 29 is a vertical sectional view taken substantially along the line XXIX—XXIX of FIG. 27, the device being operated in the opening direction.
Figure 30:
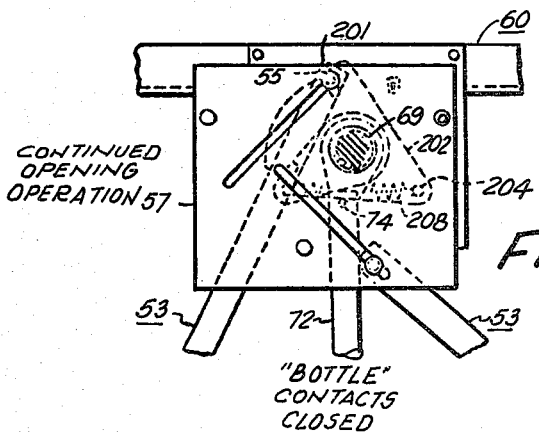
FIG. 30 is a view similar to that of FIG. 29, but illustrating the device at the end of the opening stroke.

The blade assemblies 28 are more clearly illustrated in FIGS. 5–7 of the drawings. The movable blade assembly 28 (FIG. 26, 26A) may, for example, comprise two spaced conducting blade segments 37, which are urged together by pin-and-washer biasing assemblies 38 FIGS. 26A, so that during their rotary motion they will make good contacting engagement with the auxiliary jaws, or auxiliary terminals 40, which are connected to the upper movable contacts 42 of the several vacuum interrupters 27. Thus, as illustrated more clearly in FIG. 5, rotary motion of the blade assembly 28 first makes conducting engagement with the auxiliary jaw 40, and further closing rotary movement, as shown in FIGS. 6 and 7, causes finally engagement of the rotary blade assembly 28 with the lower main jaw 22 of the switch. A flexible conductor 44 may interconnect the upper conductor stud 46 to the blade assembly 28, so that current will pass from the upper feeder terminal bushing 2 through the flexible strap 44 to the movable blade assembly 28 and thence through the stationary main jaw, or terminal 22 and consequently to one of the lateral straps 23, 24 or 25. FIG. 2 may be referred to in this connection.

Figure 14:
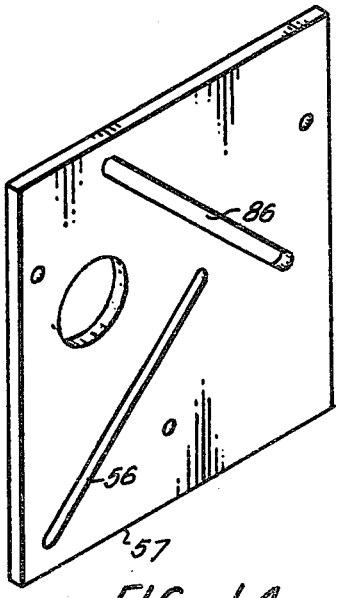
FIG. 14 is a perspective view of the guide plate having the guide slots provided therein to guide the thrust linkages.

In accordance with the improved switch construction 1 of the present invention, there is provided an improved quick-make and quick-break operating mechanism 48, which is operated in response to motion of the insulator assemblies 31 or 32. In more detail, with reference to FIG. 4, it will be observed that there is provided a crank-arm 50 affixed to the rotatable shaft assembly 31, 32 which is pivotally connected, as at 51, to a push-rod 53, the latter preferably comprising a pair of spaced push-links **53*a*, 53*b* (FIG. 2), the upper ends of which have a guide or thrust pin 55 extending laterally therethrough. As shown in FIG. 4, the guide pin 55 moves within a guide slot 56 provided in a guide plate 57 (FIG. 14) fixed to the main frame 60 of the switch 1. As a result, with respect to FIG. 5, which shows a closing operation of the switch 20, the guide pin 55 enters the recess 61 in the actuating toggle-lever plate 63, which is shown in more detailed fashion and enlarged in FIG. 9 of the drawings. The thrusting action of the push-links 53*a*, 53*b* causes counterclockwise rotary motion of the actuating toggle-lever plate 63, which carries the toggle-knee pin 64 of an overcenter toggle linkage 66 overcenter to result in a first compression of the telescopic-type toggle compression spring 67, and subsequently a quick movement of the toggle 66 overcenter, as illustrated in FIG. 6 of the drawings. Continued clockwise rotary closing motion of the shaft assembly 31 will again cause, through the interconnection of the pivot pin 55 within the recess 61 of the actuating toggle lever plate 63, this time clockwise rotation of the toggle-lever plate 63 to again carry the toggle linkage 66 overcenter to its original position. This constitutes a double-toggle action of the over-center toggle linkage 66. As will be brought out more clearly hereinafter the first toggle actuation closes the contacts 42, 43 within the vacuum bottle 27, and the second toggle actuation snap-opens the contacts 42, 43 within the vacuum bottle 27**.

Extending longitudinally centrally of the switch frame 60 is a contact-operating shaft, designated by the reference numeral 69 and having a torsion-spring connection 70 with each of the movable contacts 42 of the several vacuum interrupters 27. The rotary contact shaft 69 is connected, by means of arms 71 and insulating links 72 to the upper movable contacts 42 of the vacuum interrupters 27. Generally, it is desirable, during the closing operation for the circuit to be made within the vacuum interrupters 27, as illustrated more clearly by FIGS. 5, 6 and 7 of the drawings. With respect to these drawings, it will be observed that first the blade assembly 28 engages the auxiliary jaw 40 and transfers the current through the vacuum interrupter 27, as shown in FIG. 6, and finally, upon the opening of the vacuum interrupter 27 (FIG. 7), the blade 28 closes on the main jaw 22 to thereby close the switch 20.

Due to the fact that there is spring pressure 73 exerted on the separable contacts 42, 43 within the vacuum interrupters 27 by virtue of the biasing action exerted by the torsion springs 73, it is desirable to latch the operating shaft 69 in the contact-closed position, as shown in FIG. 6 until the full thrust of the overcenter spring 67 is obtained. With respect to FIGS. 5–7, it will be observed that the latching action is achieved by pivotally-mounted latch levers 76, 77, which engage corner portions 79, 80 (FIG. 13) provided on the rotatable shaft-operating lever 82, the latter being fixedly keyed to the contact-operating shaft 69.

Figure 13:
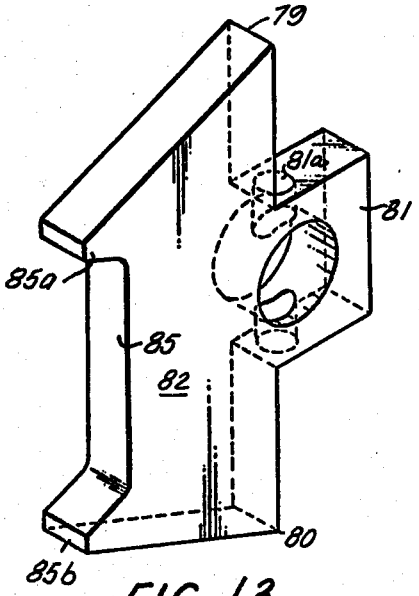
FIG. 13 is an enlarged perspective view of the operating lever for the contact shaft assembly.

In more detail, the shaft-operating lever 82, illustrated in FIG. 13 of the drawings, is keyed by a pin 83 (FIG. 6) to the contact operating shaft 69. The shaft operating lever 82 has a recess 85 provided therein having two end abutment portions 85*a* and 85*b* which are struck by the toggle knee pin 64 of the toggle linkage 66 in its overcenter action. This rotates the contact shaft 69 and causes opening and closing of the contacts 42, 43 within the vacuum-interrupting unit 27.

With respect to the dotted lines 52 which show the path of movement of the thrust pin 55 in FIG. 6, taken in conjunction with FIG. 7, it will be observed that the actuating-toggle lever plate 63 is engaged by the thrust pin 55 a second time and thus causes overcenter action of the toggle linkage 66 a second time, while the shaft-operating lever 82 is maintained in a latched-fixed contact-closed position by the upper latch lever 76 as shown in FIG. 6.

Following overcenter action of the toggle linkage 66 the second time, an arm 84 (FIG. 9) secured fixedly to the actuating toggle lever plate assembly 63, releases the upper latch arm 76 and thereby permits snap rotation contact-opening motion of the shaft-operating lever 82. This is more clearly seen in FIGS. 6 and 7 of the drawings.

It will be observed that the guide plate 57 (FIG. 14) has two guide slots 56 and 86 provided therein to accommodate the thrust pins 55, 88 for each of the two thrust linkages 53 associated with the two switches 20, 21. As a result, should one switch be actuated, the interposition of the cam portions 90, 91 (FIG. 9) will prevent the other thrust pin 55 or 88 from being manually actuated. An interlocking arrangement is consequently provided, so that only one switch 20 or 21 can be operated at a time. It is only following the completion of the opening or closing motion of one switch 20 or 21, that the other switch can be brought into "play" and operated.

Figure 9:
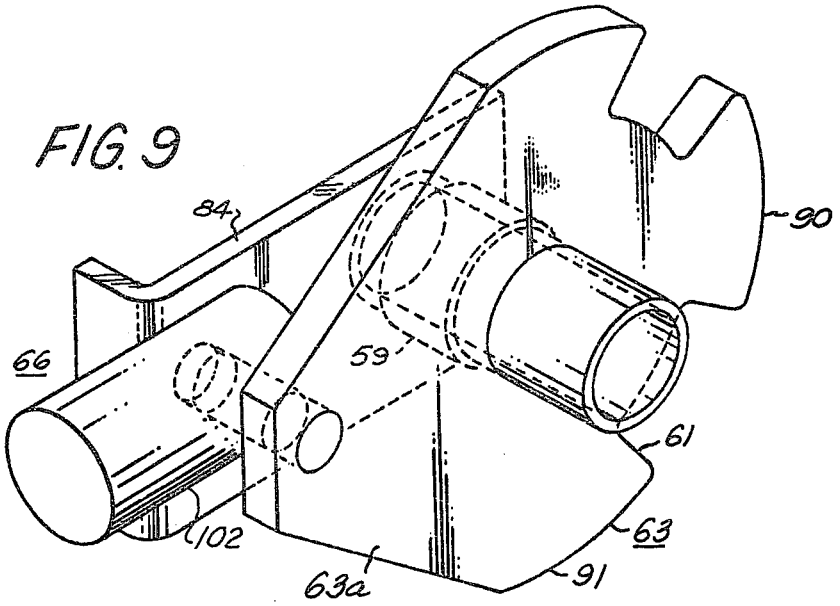
FIG. 9 is an enlarged perspective view of the actuating toggle lever plate, as assembled with its releasing lever.
Figure 10:
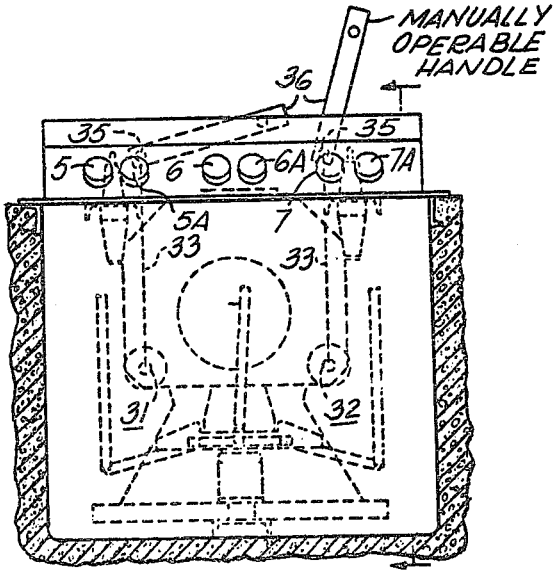
FIG. 10 is a somewhat diagrammatic end view of the bi-switch construction of the present invention showing the manual operating handles.
Figure 11:
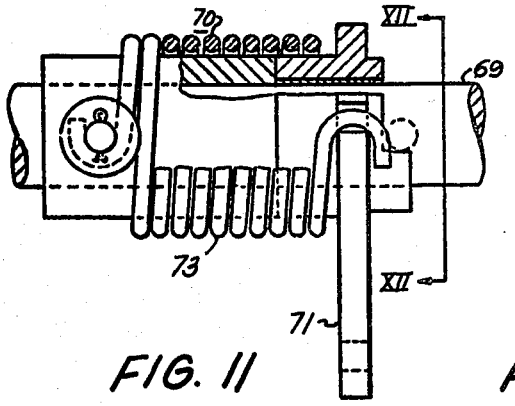
FIG. 11 is an enlarged detailed view of one of the torsion spring assemblies for providing contact pressure within the vacuum interrupters.
Figure 12:
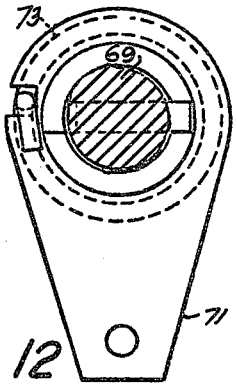
FIG. 12 is a sectional view taken substantially along the line XII—XII of FIG. 11.

The crank-arm assembly 63 is more clearly shown in FIG. 9 of the drawing, and comprises, generally, the crank-arm proper 63*a* affixed to a sleeve 59, which pivots about the shaft 69, the sleeve 59 having the latch-releasing arm 84 fixedly secured thereto. In other words, the crank-arm assembly 63 is loosely mounted about the contact operating shaft 69, and the latch release arm 84, forming a part of the crank-arm assembly 63, serves to release the latch levers 76 and 77, as more clearly shown in FIGS. 4–7 of the drawings.

FIG. 13 more clearly illustrates the shaft operating arm 82, which is keyed, or otherwise fixedly secured, to the contact-operating shaft 69. As shown in FIG. 13, the shaft operating arm 82 has a hub portion 81, which has a bore opening 81*a* therethrough to accommodate a keying pin 83, which also passes through the contact-operating shaft 69 itself. As a result, the operating arm 82 is fixedly secured to the contact operating shaft 69, and positively causes the opening and closing rotative motions thereof.

As will be apparent, the crank arm 63 and the telescopic spring guide member 102*a* collectively form a spring toggle mechanism 66. When the crank arm 63 and the telescopic spring guide member 102–102*a* are at an angle to each other, as shown by the full lines in FIG. 4, the compression spring 67 will act to force the operating arm 82 upwardly against the stop member 30. However, when the crank arm 63 and the telescopic spring guide member 102–102*a* are moved such that the angular relation is opposite to that shown, the force of the compression spring 67 will hold the operating arm 82 against the lower stop 39.

The telescopic spring guide member is pivotally connected by a knee pivot pin 64 to the outer periphery of the crank-arm assembly 63. The telescopic spring-guide member comprises a rod portion 102, which is telescopically received in a sleeve portion 102*a*, the latter being fixedly pivoted, by a stationary pivot pin 104, to a pair of downwardly extending flanges 101 secured, as by welding, to the frame 60 of the bi-switch structure. Thus, counterclockwise rotative motion of the operating arm 63 will carry the telescopic spring-guide member 102 overcenter, thereby causing a collapsing of the rod member 102 within the pivotally-mounted sleeve member 102*a* through an overcenter position, at which time the compression spring 67 will expand to force the crank-arm 63 to its other position.

The vacuum interrupter or vacuum "bottle" 27 is of the type well recognized in the art. Its internal construction may be set forth, for example, in U.S. Pat. Nos. 3,246,979 and 3,462,572. It will be observed that the stationary contact end 27*a* of the vacuum interrupter 27 is affixed to the main common leg, or terminal 22 having at its opposite ends the two jaw plates 22*a*, 22*b* which make sliding contacting engagement with either of the rotary blade assemblies 28, 29. The upper end 27*b* of the vacuum interrupter 27 provides a guiding action 93 for the movable contact 42 which is connected by a flexible strap 95, to the stationary auxiliary jaws 40 which make contact with the blade assemblies 28, 29 at an intermediate part of the opening and closing strokes.

The two latch arms 76, 77 are biased inwardly into engagement with the shaft-operating lever 82 by means of a tension spring 97 having its ends affixed to apertures 99, 100 suitably provided in the intermediate portions of the latch levers 76, 77.

The overcenter spring 67 is of the telescopic type, wherein a rod 102 carrying a pin-and-spring seat 103, is forced outwardly into a sleeve 102*a* thereby effecting compression of the spring 67 against the other pivot pin 104, the latter constituting the other spring seat for the biasing compression spring 67 and stationarily pivotally supporting the left hand end of the sleeve 102*a* to a bracket 101.

Figure 33:
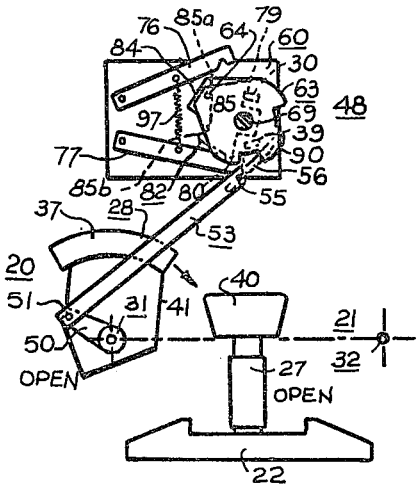

FIGS. 33–38 illustrate, sequentially, the various positions of the operating linkage 48 during the closing operation of the interrupting switch 20. With reference to FIG. 33, it will be noted that at this point the vacuum bottles 27 are open, and the interrupting switch 20 is also open. The push-rod linkage 53 is such that no engagement is present with the actuating-toggle lever-plate 63, and either switch 20 or 21 may be freely operated as selected by maintenance personnel.

Figure 34:
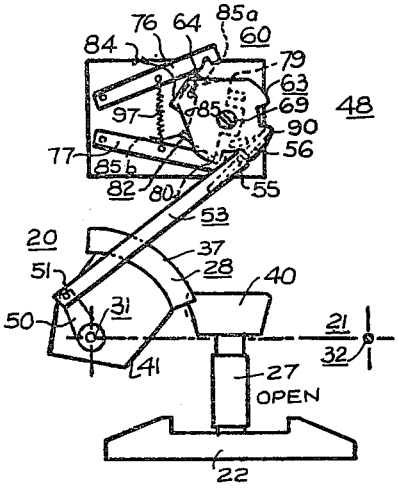

Assuming, for instance, that it is desirable to effect a closing operation of the interrupting switch 20, the clockwise rotation of the insulator assembly 31 will effect, generally, upward movement of the push-rod linkage 53, causing the upward movement of the thrusting guide-pin 55 to cause it to enter the recess 61 in the actuating-toggle lever-plate 63. This engagement is illustrated in FIG. 34 of the drawings. In other words, FIG. 34 merely shows the initial abutment of the thrusting guide-pin 55 engaging the recess 61 of toggle lever assembly 63.

Figure 35:
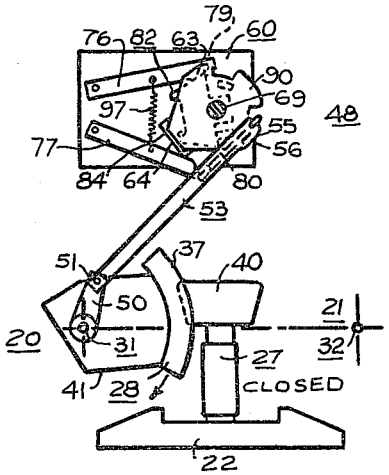

With reference to FIG. 35 of the drawings, it will be noted that in the position of the linkage parts shown, the over-center toggle-linkage 66 has been moved over-center. The latch-release arm 84 has effected disengagement of the lower latch arm 77 from the lower abutment portion 80 of the shaft-operating lever 82; and the shaft-operating lever 82 has been rotating the operating shaft 69 to close the contacts of the vacuum bottles 27.

Figure 36:
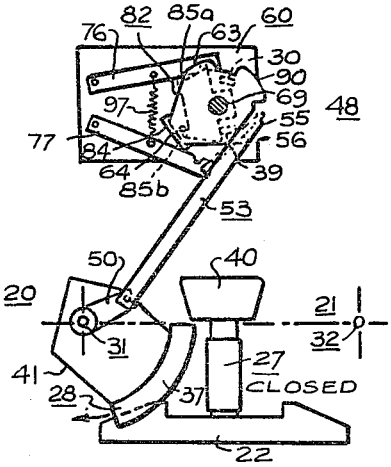

With reference to FIG. 36 of the drawings, it will be noted that the continued clockwise rotation of the insulator shaft assembly 31 is now effecting the beginning of the double-toggle action of the toggle-linkage 66 by pulling the actuating-toggle lever-plate 63 in the opposite clockwise direction about the contact-operating shaft 69. With respect to FIG. 37, it will be observed that in the position of the linkage parts shown, the over-center toggle-linkage has now gone over-center in an upward direction, causing the latch-release arm 84 to effect release of the upper latch-arm 76, and thereby tripping the contacts of the vacuum interrupters 27 to the open position.

Figure 38:
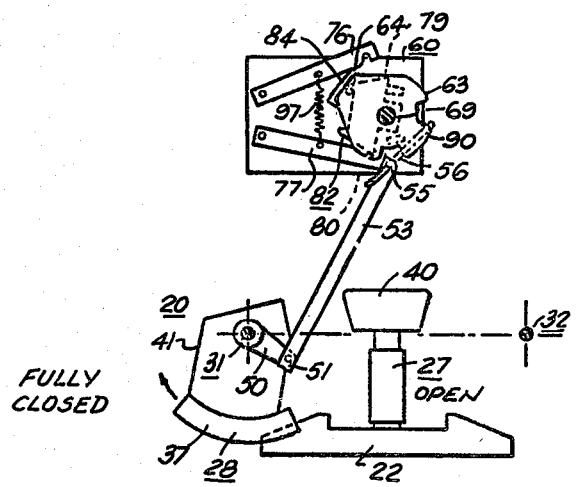

FIG. 38 illustrates the fully closed-circuit position of the interrupting switch 20, with the lower latch-arm 77 holding the vacuum bottles 27 open by engagement of the latching portion 77*a* with the abutment portion 80. In FIG. 38, it will be noted that the guide pin 55 has been retracted from the recessed portion 61 of toggle lever plate 63 to a disengaged position therefrom.

With respect to current flow in the several FIGS. 33–38, it will be observed that in FIG. 33 no current flows through the interrupting switch 21, since the moving contact blade 28 is separated from the auxiliary jaw contact 40. In FIG. 34, the moving blade 28 has engaged the auxiliary jaw contact 40, but since the contacts of the vacuum bottles are open, no current flows through the switch. However, in FIG. 35, the vacuum bottles are closed, so that in FIG. 35 there is full current flow through the switch 20 by way of the vacuum bottles 27. With respect to FIG. 36, the rotatable blade-assembly 28 has disengaged from the auxiliary jaw contact 40, but has made contact with the main stationary jaw contact 22, thereby carrying full current flow through the interrupting switch 20. In FIG. 36, however, the vacuum bottles are closed, but are not carrying any current in view of the disengagement between the upper tip portion of the blade assembly 28 and the auxiliary jaw contact 40.

Figure 37:
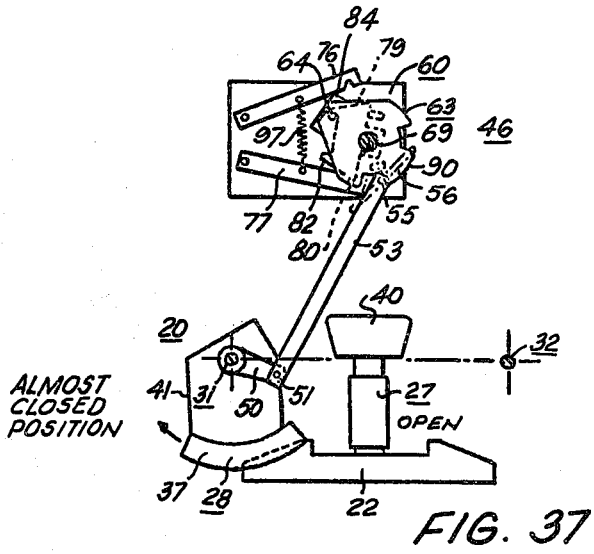

FIG. 37 illustrates the almost closed position of the interrupting switch 20, with the vacuum bottles 27 opened, current however passing through the interrupting switch 20. As mentioned, FIG. 38 illustrates the fully-closed position of the interrupting switch 20 with he vacuum bottles, as before, in the open-circuit position.

Figure 8:
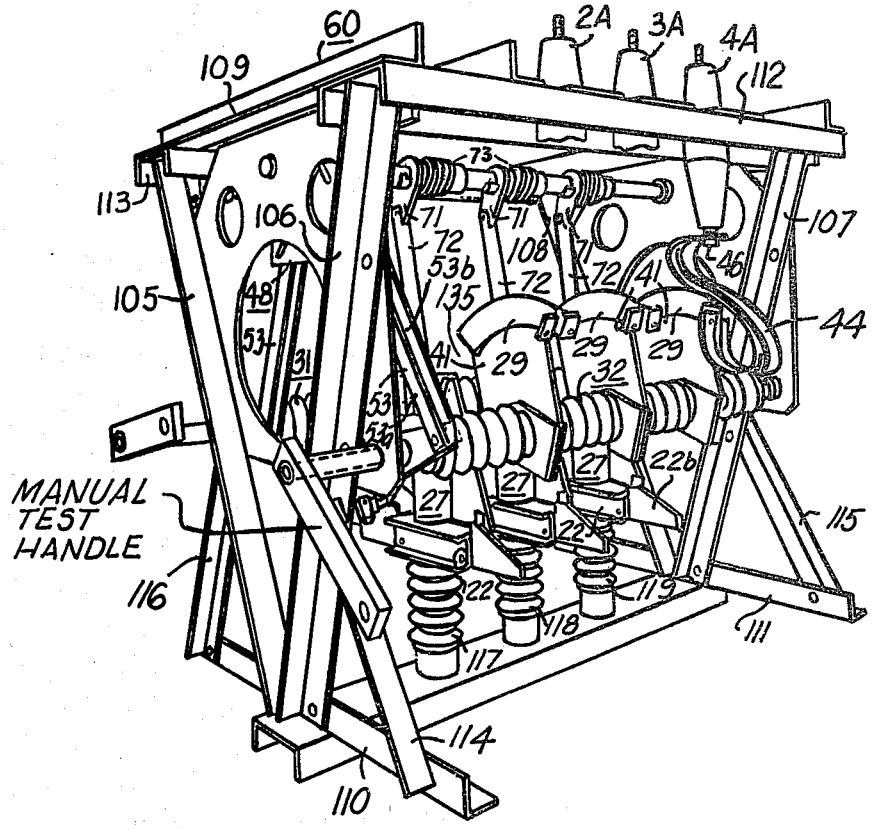
FIG. 8 is a perspective view of the operating linkage of the improved bi-switch construction of the present invention.

Generally, a frame 60 is provided, which supports the several component parts of the two switches 20, 21 and the centrally-provided vacuum interrupters 27. In more detail, the frame comprises a number of angle irons 105 to 116 (FIG. 8) with post insulators 117–119, the latter supporting the vacuum interrupters 27 in a generallyvertical position, as shown more clearly in FIG. 8 of the drawings.

The use of torsion springs 73 for providing the proper contact pressure is set forth and claimed in U.S. Pat. application W.E. Ser. No. 41,963 filed May 10, 1971, Ser. No. 141,686 by Charles Bice, Robert Few and Frank Senchur. By the provision of torsion springs 73 as contact-compression springs, there is provided a considerable insulating distance between the upper rotary shaft assembly 69, which is at ground potential, and the upper ends 27*b* of the vacuum interrupters 27, which at times, are at high voltage.

Figure 18:
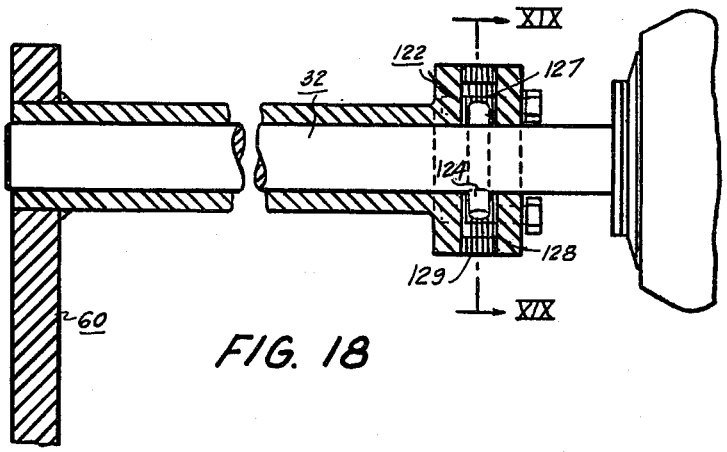
FIG. 18 is a fragmentary sectional side view of the movable-blade shaft assembly.
Figure 19:
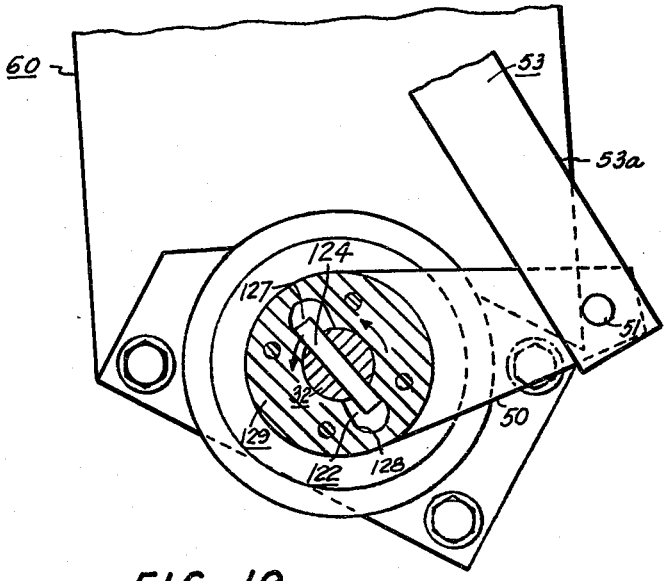
FIG. 19 is a fragmentary sectional view taken substantially along the line XIX—XIX of FIG. 18.
Figure 20:
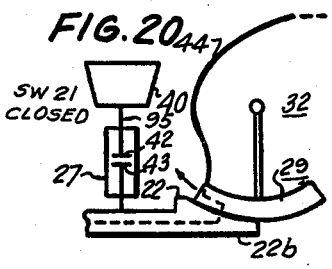
FIG. 20 illustrates diagrammatically the switch in the "closed", position during the beginning of an opening operation.
Figure 21:
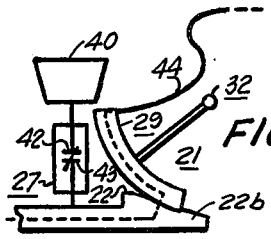
FIGS. 21–25 are views similar to FIG. 20, but showing progressive opening movements of the movable blade assembly of the switch being opened.
Figure 22:
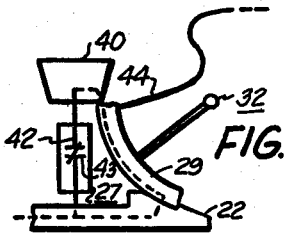
Figure 23:
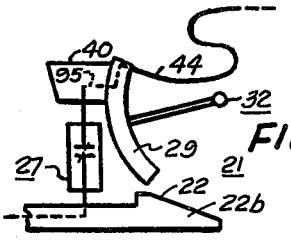
Figure 24:
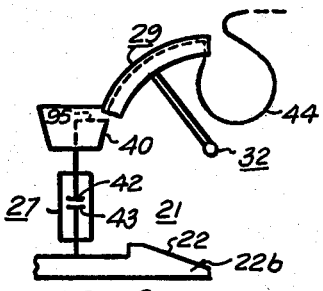
Figure 25:
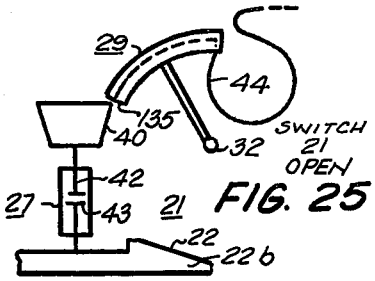

In order to provide a prior movement of the thrust linkage 53 before the contact-blade assemblies 28, 29 are moved there is provided a lost-motion arrangement 122, as shown in FIGS. 18 and 19 of the drawings. A shaft pin 124, passing through the shaft 32, makes engagement with recesses 127, 128 provided in a laminated block 129 to provide an initial slight preceding motion of the operating linkage 53 before a subsequent rotary movement of the operating-blade shaft assemblies 31, 32. This was felt desirable to provide the prior timing. However, it is to be clearly understood that the provision of such a lost-motion connection 122 is not necessary to the utilization of the invention, but was merely employed as an expedient in the commercial version to obtain the proper operating sequence.

Figure 32:
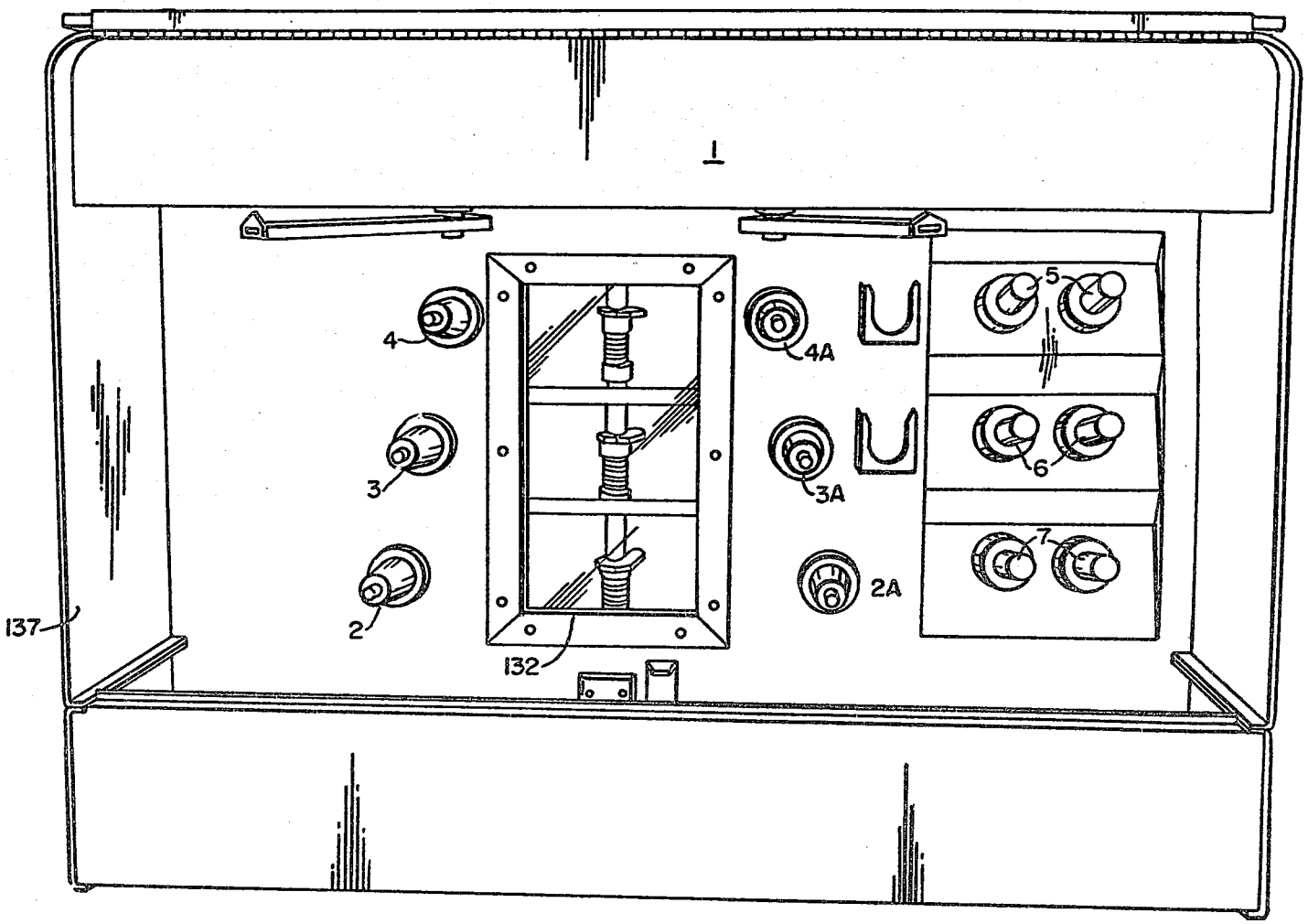
FIG. 32 illustrates the switch of the present invention, as applied to a pad-mounted arrangement for residential distribution circuits; and, FIGS. 33–38 illustrate the sequence of the linkage movements during the closing operation of one of the two switches.

The switch construction 1 of the present invention has wide application. FIG. 32 illustrates the switch arrangement as applied to a pad-mounted construction. It will be observed that in this instance, the switch arrangement 130 is such that the primary feeder bushings 2, 3, 4, 2A, 3A, 4A extend out the side of the enclosure 137, with the window 132 providing a visible view of the isolating switch gap 134 or 135, (FIG. 5) which is of course, desirable for assuring to operating personnel that high voltage is removed from the laterals 5, 6, 7, 5A, 6A and 7A. The terminal bushings 5, 6, 7 for the laterals 5, 6 and 7 are provided to the right of FIG. 32. If desired, fuses (not shown) may be associated with the laterals 5, 6 and 7 and preferably are of the current-limiting type.

Figure 17:
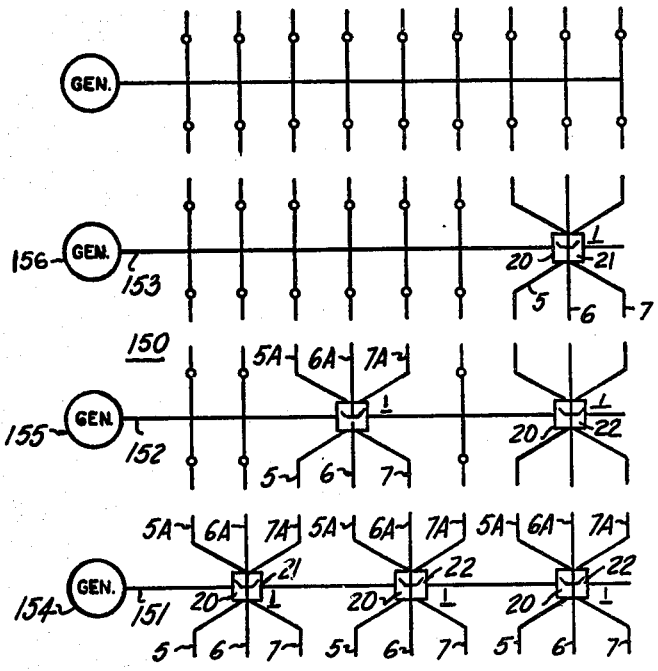
FIG. 17 is another more comprehensive diagrammatic view showing the manner of connection of the improved "T" switch of the present invention as applied in a residential distribution system.

FIG. 17 generally shows the arrangement of the improved switch construction 1, as provided in a distribution system 150. It will be observed that the primary feeders 151, 152 and 153 extend from the generating stations 154, 155 and 156, and the switch constructions of the present invention are desirable to sectionalize intervening portions of the primary feeders and to obtain a selectivity in regard to the laterals.

FIGS. 27, 28, 29 and 30 show an alternate overcenter mechanism utilizing an over-center extension spring mechanism. As the push links 53 engage the slot 201 in the spring-anchor plate 202 and rotate it clockwise as viewed in FIG. 29, the spring anchor pin 204 moves through the line bisecting spring anchor pin 206 and contact-operating shaft 69 at which time the spring force 208 causes counterclockwise rotation of the shaft operating lever 210 to which spring anchor pin 206 is affixed. Continuing switch operation causes push links 53 to retract from the mechanism thus rotating the spring anchor plate 202 in a counterclockwise direction which allows the spring anchor pin 204 to cross back through the line bisecting spring anchor pin 206 and contact-operating shaft 69 resulting in a clockwise rotation of the shaft operating lever 210. The above-described counterclockwise then clockwise rotation of the contact-operating shaft 93, closes then opens the bottles respectively, as is necessary for the basic operation of the switch.

From the foregoing description, it will be apparent that there has been provided an improved switch construction 1 in which the interrupting device 27, 160 may be of a reduced rating because they carry current only for such a short time. In other words, although the primary feeders may be suitable for 600-ampere capacity, nevertheless, because of the short time duration, that the vacuum interrupters 27 are in circuit, they may be of the 200-ampere rating, even though they will be carrying 600 amps during the brief time that they are in the circuit. Moreover, it will be apparent that there results, from the foregoing construction, halving of the usual number of interrupting devices 27, which are required, inasmuch as either switch 20, 21 may use the same set of vacuum-interrupting devices 27.

It will be observed that the bi-switch construction 1 of the present invention is particularly adapted, for example, to 600/200 amp 3330 T-Tap switch applications in underground systems for line sectionalizing purposes of three-phase distribution circuits. The application of this bi-switch construction 1 increases the reliability of service to underground customers by providing flexible switching of electrical circuits. The switching is safe because vacuum switching and air dielectric is used in the isolating gaps. Visible break of the switch contacts through the window 132 is also possible.

Figure 31:
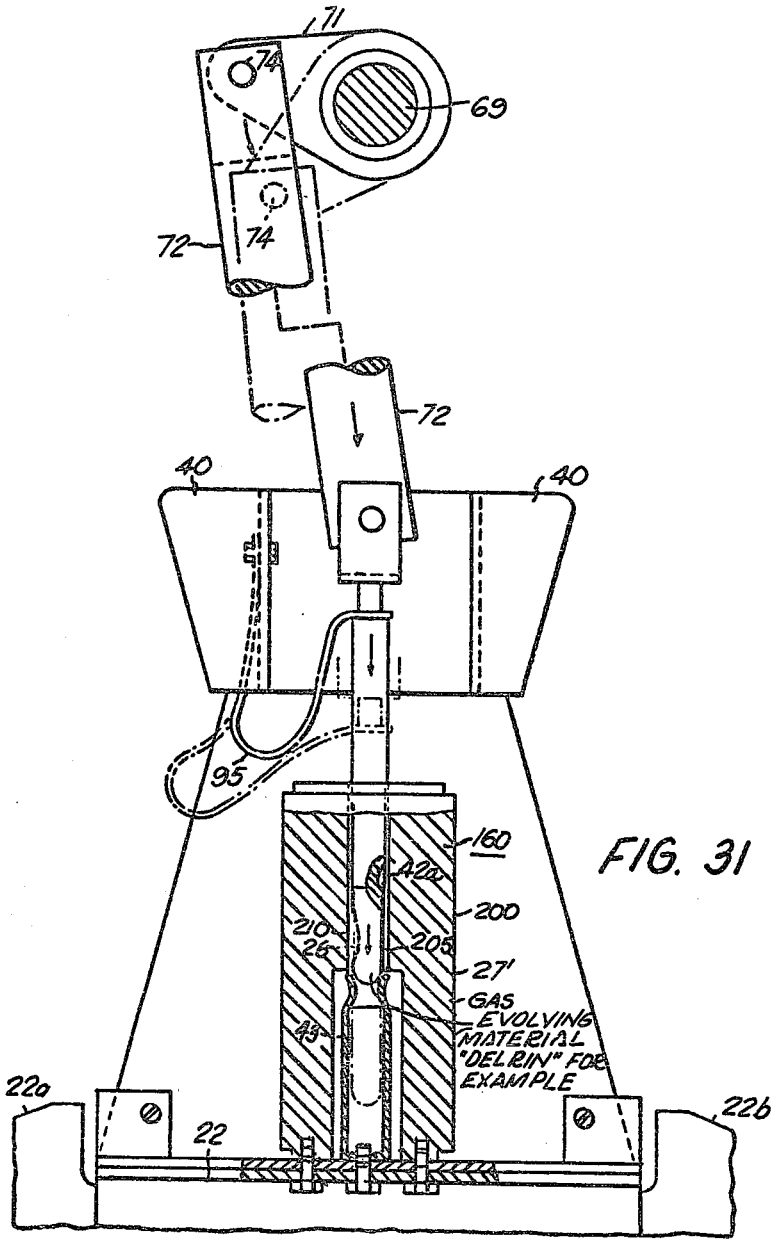
FIG. 31 illustrates the modified-type of interrupting unit, which may be substituted for the vacuum-interrupting unit of the device illustrated in FIG. 3.

Advantageous constructional features of the bi-switch device 1, 130 of the present invention are as follows:

1. Vacuum load-switching of three phase-600 ampere circuits are possible.
2. A visible air break is provided.
3. Air dielectric may be used in the isolating gap.
4. 600 amp bushings are adaptable for ESNA connectors.
5. 200 A and P wells for bushings are adaptable for load or non-load break.
6. Non-corrosive housing is used for submersible unit application.
7. Attractive low-profile pad-mounted unit with a completely dead front.
8. Electrical ratings, which for one typical example, may be provided are indicated below:

Electrical Ratings:

1. Design Voltage Rating: 15.5 KV RMS
2. Continuous Current
   Feed through: 600 Amps RMS
   Tap: 200 Amps RMS
3. Momentary Current Rating: 20,000 Amps RMS
4. One Second Current Rating: 10,000 Amps RMS
5. One Minute 60 Cycle Withstand. 35 KV
6. Basic Impulse Level: 95 KV The improved bi-switch construction of the present invention is, as mentioned, adaptable for many types of environments, such as the submersible or the pad-mounted switch construction. The same interrupting units 27 may be used for the operating of either the switch assembly 20 or alternatively, with the switch assembly 21. Thus, the number of interrupting units 27 is thereby reduced, and economies are thereby achieved. It is to be clearly understood that the present invention is not restricted in its use only to the use of vacuum-type circuit interrupters 27. For example, other types of interrupters may be used. FIG. 31 shows an alternate type of interrupting structure in which instead of vacuum interrupters 27 being used, in their stead the interrupting units 160 are employed.

The alternate-type of interrupting unit 160 comprises a generally cylindrical-type casing 200, formed of a gas-evolving material, for example "Delrin". Other materials, such as fiber, could be used, however. As shown in FIG. 31, a finger-type stationary contact 43 is provided cooperably with a movable contact 42*a*, assuming the form of a sleeve surrounding a plug 205, also formed of a suitable gas-evolving material, such as, for example "Delrin".

During the opening operation, it will be obvious that the upward movement of the movable cylindrical contact 42*a* within the bore 210 of the casing 200 will establish an arc, designated by the reference numeral 26, and this arc will generate, because of the heat evolved, evolution of considerable gas from the gas-evolving casing and plug materials. The evolution of such evolved gas will quicklybring about arc extinction.

Thus, the bi-switch construction 1 is not restricted to the use of vacuum "bottles 27" but may encompass other alternate forms of interrupting devices, such as the gas-evolving single-break device 160 of FIG. 31, which may be alternately used in place of the vacuum "bottle" 27, illustrated in FIG. 5–7 of the drawing.

Additionally, altough the mechanism 66 includes an overcenter toggle-type mechanism, nevertheless, for certain applications, an overcenter spring-arm mechanism 200 may be utilized, as illustrated in FIGS. 27–30 of the drawings.

Although there has been illustrated and described specific structures, it is to be clearly understood that the same were merely for the purpose of illustration, and that changes and modifications may readily be made therein by those skilled in the art, without departing from the spirit and scope of the invention.

I claim:

1. A switch including a first terminal means, means defining a second terminal means spaced away from said first terminal means, a movable conducting member, actuating means for moving the movable conductor member to thereby electrically interconnect the first and second terminal means, an interrupting device having separable contacts, means defining an auxiliary terminal associated with said interrupting device, one of said separable contacts of said interrupting device being electrically connected to said second terminal means and the other separable contact of said interrupting device being connected to the auxiliary terminal of the interrupting device, operating means for opening and closing the separable contacts of the interrupting device, the said operating means being mechanically responsive to the actuating means so that the closing motion of the actuating means will cause corresponding closing motion of the operating means to thereby close the separable contacts of the interrupting device but only after contacting engagement of the movable conducting member with the auxiliary terminal of the interrupting device, and said operating means effecting a reopening of the separable contacts of the interrupting device following an electrical interconnection of the movable conducting member with the said second terminal means.

2. The switch structure of claim 1, wherein the movable conducting member is a rotary conducting blade.

3. The switch structure of claim 2, wherein the auxiliary terminal of the interrupting device is a stationary jaw contact making sliding electrical contacting engagement with the rotary conducting blade.

4. The switch structure of claim 1, wherein the operating means for opening and closing the separable contacts of the interrupting device is of the quick-make and quick-break type.

5. The switch structure according to claim 1, wherein the interrupting device is a vacuum-type circuit interrupter with the separable contacts disposed within an evacuated enclosure.

6. The switch structure of claim 1, wherein the operating means for opening and closing the separable contacts of the interrupting device is of the overcenter spring-toggle type.

7. The switch structure of claim 1, wherein the operating means for opening and closing the separable contacts of the interrupting device comprises an operating shaft with an operating lever keyed thereto, said operating means also comprising an overcenter thrust linkage, the actuating means forcing overcenter movement of said thrust linkage, and an actuating toggle lever plate is pivotally mounted and is rotated by said thrust linkage moved by said actuating means.

8. A rotary transfer switch construction including first and second rotary switches having a common terminal means (22), each of said first and second rotary switches having a rotary shaft assemblage associated therewith, a pair of rotary conducting switch-blade assemblies operated by said rotary shaft assemblages for making, at times, contacting engagement with said common terminal means, an intervening interrupting device having normally-open separable contacts and an auxiliary terminal (40), one of said separable contacts of the interrupting device being at all times electrically connected to said common terminal means, the other of said separable contacts of the interrupting device being connected to said auxiliary terminal (40), which is in the line of travel of both of the rotary switch-blade assemblages, quick-make and quick-break operating means for operating with a snap action said normally-open separable contacts of the intervening interrupting device, and means responsive to the motion of each of the rotary shaft assemblages for initiating actuation of the quick-make and quick-break mechanism, whereby during the closing operation of one of the rotary switches its respective conducting switch-blade assemblages first makes contacting engagement with the auxiliary terminal of the interrupting device, and subsequently the separable contacts of the interrupting device are caused to close during such a closing operation to avoid prestriking at the auxiliary terminal (40) and following engagement between the switch-blade assemblage and the common terminal means (22) the separable contacts of the interrupting device are caused to again open.

9. The combination of claim 8, wherein the quick-make and quick-break operating mechanism of the intervening normally-open interrupting device comprises a rotary-contact shaft assemblage having an operating lever keyed thereto, means for momentarily latching said operating lever in a stationary position, an overcenter-spring mechanism comprising an actuating-toggle lever plate which is loose on the shaft, and thrust-rod means operable from both rotary shaft assemblages for causing overcenter action of the overcenter spring mechanism, while the operating lever is latched in a stationary position.

10. A multi-phase load-break switch assembly comprising, in combination, means defining a metallic grounded switch frame, a pair of laterally-spaced rotatable contact shaft assemblies supported for rotation in said switch frame, a plurality of spaced movable blades insulated from each other and rotatable with each shaft assembly, a quick-make and quick-break over-center toggle mechanism supported at one end of said grounded switch frame, two laterally-spaced switch assemblies including a common terminal disposed adjacent one side of the switch frame, each switch assembly having a remote isolated terminal for each phase located toward the opposite side of the switch frame, a common interrupting device having normally-open separable contacts for each phase disposed between the two switch assemblies and having a pair of normally-open separable contacts, one of said normally-open separable contacts constantly electrically connected to said common terminal, and the other normally-open separable contact connected to an auxiliary terminal, each auxiliary terminal being disposed in the path of movement of corresponding movable blades of the two switch assemblies, and a rotatable operating shaft extending down said other side of the switch frame and rotatably carrying the operating rods for the movable contacts of the normally-open interrupting device.

11. The multi-phase load break switch assembly of claim 10, wherein the pair of laterally-spaced rotatable contact shaft assemblies and the rotatable operating shaft are disposed in generally parallel relationship.

12. The multi-phase load break switch assembly of claim 10, wherein the quick-make and quick-break overcenter toggle mechanism comprises a toggle-leg plate slidably rotatable upon said rotatable operating shaft, and an actuating plate keyed to said rotatable operating shaft and having a lost-motion connection with said toggle-leg plate.

13. The multi-phase load break switch assembly of claim 10, comprising a chain-drive for effecting rotation of the laterally-spaced rotatable contact-shaft assemblies, and thrust-links interconnecting the pair of laterally-spaced rotatable contact shaft assemblies with the quick-make and quick-break operating mechanism.

14. The multi-phase load-break switch assembly of claim 10, wherein the normally-open interrupting device for each phase comprises a vacuum interrupter unit.

15. A multi-interrupter switch comprising, in combination, two switches having a common line terminal, said two switches each having also a separate remote spaced line terminal, a normally-open interrupting device with interrupting capability having separable normally-open cooperable contacts associated therewith one of which is electrically connected at all times to said common line terminal, each of said two switches having its own respective independently-movable switch-blade, means defining an auxiliary terminal electrically connected at all times to the other separable contact of the normally-open interrupting device, and said auxiliary terminal situated in the path of opening and closing movements of both movable switch-blades, so as to make electrical contact, at times, with both independently-movable switch-blades, whereby the closing of either interrupter switch will close its circuit through the normally-open separable contacts of the normally-open interrupting device, and also the opening of either interrupter switch will open the circuit across the separable contacts of the normally-open interrupting device, thus relieving both interrupter switches from opening and closing duty.

16. The multi-interrupter switch combination of claim 15, wherein the normally-open interrupting device is a vacuum-type circuit interrupter.

17. The multi-interrupter switch device of claim 15, wherein the switch-blades make sliding contacting engagement with the auxiliary terminal of the normally-open interrupting device.

18. The multi-interrupter switch combination of claim 15, wherein a quick-make and a quick-break mechanism for the normally-open interrupting device is provided, and each of the interrupter switches has an actuating member which is capable of initiating operation of said quick-make and quick-break operating mechanism.

19. The combination according to claim 18, wherein the quick-make and quick-break mechanism has interlocking means provided therewith, so that during the operation of one of the interrupter switches it is mechanically impossible to effect simultaneously the operation of the other interrupter switch.

20. The combination according to claim 18, wherein each actuating member comprises a thrust-rod linked to the respective independently-movable switch-blade.

21. The combination according to claim 18, wherein the quick-make and quick-break mechanism includes a rotary contact-operating shaft, an actuating member keyed to said shaft, and an overcenter spring-toggle device having an actuated toggle-lever plate loosely mounted on said rotary contact shaft.

22. A quick-make quick-break operating linkage for a circuit interrupter having normally-open separable contacts, comprising, in combination, an overcenter spring-actuating mechanism including a rotatable initiating master member and a follower slave member, spring means associated with said initiating master member and said follower slave member for overcenter snap-action movement of said members, shaft means having an actuating arm member affixed thereto to cause the rotation thereof in one direction to close the contacts and in the opposite direction to open the separable contacts, means causing inter-engagement of said follower member with said actuating arm member subsequent to overcenter travel of said follower member.

23. The combination of claim 22, wherein the overcenter spring-actuating mechanism includes an overcenter toggle mechanism with a compression spring associated therewith for snap-action.

24. The combination of claim 22, wherein latching means are provided for latching said actuating arm in at least one contact position thereof.

25. The combination of claim 22, wherein a rotatable prime moving member is provided, and thrust-operating linkage is interposed between said prime moving member and said rotatable initiating master member.

26. The combination according to claim 22, wherein said rotating initiating master member includes a peripheral recess, and a thrust linkage is provided to at times engage said peripheral recess.

27. A quick-make quick-break operating linkage for a circuit interrupter having separable contacts, comprising, in combination, an overcenter spring-toggle mechanism including a rotatable initiating master toggle leg member and a follower toggle leg member, compression-spring means associated with said leg members for overcenter snap-action, shaft means having an actuating arm member affixed thereto to cause the rotation thereof in one direction to close the contacts and in the opposite direction to open the normally-open contacts, means causing interengagement of said follower toggle leg member with said actuating arm member following overcenter movement of said overcenter toggle mechanism.

28. The combination according to claim 27, wherein the rotatable initiating master toggle leg member has at least one peripheral recess provided thereon, and thrust-linkage means is used to engage said peripheral recess.

29. The combination according to claim 27, wherein rotatable prime operating means is provided having an arm, and thrust linkage means interconnects said rotatable prime member and the rotatable initiating toggle-leg member.

30. A switch including a first terminal means, means defining a second terminal means spaced away from said first terminal means, a movable conducting member, actuating means for moving the movable conducting member to electrically bridge the first and second terminal means, a normally-open interrupting device having normally-open separable contacts, means defining an auxiliary terminal, one of said separable contacts of the interrupting device being electrically connected to said second terminal means and the other separable contact of said normally-open interrupting device being connected to the auxiliary terminal, said actuating means causing contacting engagement of the movable conducting member with the auxiliary terminal for only a relatively short momentary time during the closing operation of the switch and separating away therefrom at the end of the closing operation of the switch for an observable visible break therebetween, operating means for opening and closing the normally-open separable contacts of the normally-open interrupting device, said operating means being responsive to the actuating means so that closing motion of the actuating means will cause corresponding closing motion of the operating means to temporarily close the separable contacts of the normally-open interrupting device but only during said momentary time of contacting engagement of the movable conducting member with the auxiliary terminal.

31. The switch structure of claim 30, wherein the movable conducting member is a rotary conducting blade.

32. The switch structure of claim 31, wherein the auxiliary terminal is a stationary jaw making sliding contacting engagement with the rotary conducting blade.

33. The switch structure of claim 30, wherein the operating means for opening and closing the normally-open separable contacts of the normally-open interrupting device is of the quick-make and quick-break type.

34. The switch structure according to claim 30, wherein the normally-open interrupting device is a vacuum-type circuit-interrupter.

35. The combination according to claim 30, wherein the separable contacts of the normally-open interrupting device are in the open-circuit position in the closed-circuit position of the switch.

36. Sectionalizing switchgear for selectively connecting two electrical lines with each other and with a third electrical line, comprising, in combination, means defining a normally-open, load-break switch having separable contacts and opposite terminals, two adjoining first and second air-break switch means each having a first line-terminal and a spaced second line-terminal together with a movable conducting member for electrically interconnecting the respective first and second line-terminals of the particular switch, said two second line-terminals of the two switches being electrically connected to each other and also to one of the load-break switch opposite terminals, means defining a stationary auxiliary terminal associated with said load-break switch means electrically connecting the other opposite load-break switch terminal to said stationary auxiliary terminal of the load-break switch, means defining a quick-make and quick-break operating mechanism for quickly actuating said normally-open load-break switch to its open- or closed-circuit positions, means defining first and second independently and selectively operable actuating means for selectively actuating either the first or the second air-break switch means for thereby moving the respective particular movable conducting member of the particular selected air-break switch to electrically interconnect the respective first and second line-terminals of the selected air-break switch, said quick-make and quick-break operating mechanism of said load-break switch being responsive to the actuation of either of the first or second said independently-operable actuating means, the movable conducting member of each of the first and second air-break switch means being so arranged to first electrically contacting said auxiliary stationary terminal of the load-break switch means prior to its subsequent engagement with the second selected line-terminal means, said quick-make and quick-break operating mechanism of the load-break switch also being operable to close the separable contacts of the load-break switch means only after elect engagement with the respective movable conducting member with the auxiliary stationary terminal and subsequently to open the separable contacts of the load-break switch following interengagement of the respective movable conducting member with the respective second line-terminal means, and interlocking means for interlocking the first and second actuating means so that only one selected actuating means may be operable at a time.

37. In combination, first and second separated air-break switch means each having a first line-terminal and a second line-terminal, means electrically connecting the two second line-terminals together, means defining a load-break switch means generally interposed as a unitary structure between the first and second air-break switch means and having a quick-make and quick-break operating mechanism associated therewith, said load-break switch means having a pair of separable contacts, one of which contacts is electrically connected at all times to said second common line-terminal means, first and second independently-operable actuating means for selectively actuating either the first or the second air-break switch means for thereby moving the respective movable conducting member thereof of the particular selected air-break switch to electrically interconnect the respective first and second line-terminals, said quick-make and quick-break operating mechanism of the load-break switch being responsive to actuation of either of the first or second selected independently-operable actuating means, an auxiliary stationary terminal associated with said load-break switch and electrically connected at all times to the other separable contact of the load-break switch, the first and second independently-operable actuating means functioning to first cause electrical interengagement between the movable conducting member of the respective selected air-break switch with said auxiliary stationary terminal and quick-break closure of the separable contacts of the load-break switch means and a subsequent opening of said separable contacts of the load-break switch means following a subsequent electrical disengagement of the respective movable conducting member from the auxiliary terminal during the closing operation, and interlocking means to prevent the actuation of both the first and second actuating means of the two air-break switch means at the same time.

38. In combination, first and second air-break switch-means (20,21), each of said first and second air-break switch-means having its own individual first line-terminal, means defining a second spaced line-terminal common to both of said first and second switch-means, means defining a load-break switch-means generally interposed between said first and second air-break switch-means and having a pair of separable contacts, one of said separable contacts being connected at all times to said common second line-terminal, means defining an auxiliary stationary terminal associated with said load-break switch-means, quick-make and quick-break operating means for actuating the separable contacts of said load-break switch-means to effect thereby quick-opening and quick-closing of the separable contacts of said load-break switch-means, each of said first and second air-break switch-means having its own individual movable conducting member making, at times, engagement and disengagement with said second common line-terminal, said stationary auxiliary terminal of the load-break switch-means being interposed in the path of movement of each of the two movable conducting members of the first and second air-break switch-means, interlocking means preventing simultaneous operation of both of the movable conducting members at the same time, first and second actuating means for operating the movable conducting member of the first and second air-break switching-means so that each air-break switching-means has its own individual independent actuating means isolated and independent of the actuating means for the other adjoining air-break switching-means, said quick-make and quick-break operating means of the load-break switching-means being responsive to the movement of both the first and second actuating means, whereby selective operation of either one of the two actuating means will concomitantly effect operation of the operating means for the load-break switch-means, whereby during the closing operation of each of the selected first and second air-break switching-means there first occurs a contacting electrical engagement between the respective movable conducting member and said auxiliary stationary terminal together with actuation of the operating means for closing of said separable contacts of the load-break switch-means following engagement of the movable conducting member with the auxiliary stationary terminal, and means effecting a quick opening movement of said separable contacts following a disengagement of the movable conducting member away from said auxiliary stationary terminal during such a closing operation and subsequent to the electrical engagement between said movable conducting member and said second common line-terminal, and during the opening operation said particular actuating means functioning to effect a quick closing and a later quick opening movement of said separable contacts of the load-break switching-means following a disengagement of the respective movable conducting member away from the said common second line-terminal and following its temporary contacting engagement with said auxiliary stationary terminal, whereby said load-break switching-means may be used commonly for the operation of either of said first and second air-break switching-means.

39. The combination according to claim 38, wherein the movable conducting member is generally of blade configuration and moves in a generally circular path.

40. The combination according to claim 39, wherein the auxiliary stationary terminal makes sliding contacting engagement with said movable blade member.

41. The combination according to claim 40, wherein the load-break switching-means comprises a vacuum bottle having the separable contacts in a evacuated environment.

42. Sectionalizing switchgear for selectively connecting two electrical lines with each other and with a third electrical line, comprising, in combination, means defining a normally-open, load-break switch having separable contacts and opposite terminals, two adjoining first and second air-break switch means each having a first line-terminal and a spaced second line-terminal together with a movable conducting member for electrically interconnecting the respective first and second line-terminals of the particular switch, said two second line-terminals of the two switches being electrically connected to each other and also to one of the load-break switch opposite terminals, means defining a stationary auxiliary terminal associated with said load-break switch means electrically connecting the other opposite load-break switch terminal to said stationary auxiliary terminal of the load-break switch, means defining operating mechanism for quickly actuating said normally-open load-break switch to its open-or closed-circuit positions, means defining first and second independently and selectively operable actuating means for selectively actuating either the first or the second air-break switch means for thereby moving the respective particular movable conducting member of the particular selected air-break switch to electrically interconnect the respective first and second line-terminals of the selected air-break switch, said operating mechanism of said load-break switch being responsive to the actuation of either of the first or second said independently-operable actuating means, the movable conducting member of each of the first and second air-break switch means being so arranged to first electrically contacting said auxiliary stationary terminal of the load-break switch means prior to its subsequent engagement with the second selected line-terminal means, said operating mechanism of the load-break switch also being operable to close the separable contacts of the load-break switch means only after electrical engagement with the respective movable conducting member with the auxiliary stationary terminal and subsequently to open the separable contacts of the load-break switch following interengagement of the respective movable conducting member with the respective second line-terminal means, and interlocking means for interlocking the first and second actuating means so that only one selected actuating means may be operable at a time.

43. In combination, first and second separated air-break switch means each having a first line-terminal and a second line-terminal, means electrically connecting the two second line-terminals together, means defining a load-break switch means generally interposed as a unitary structure between the first and second air-break switch means and having an operating mechanism associated therewith, said load-break switch means having a pair of separable contacts, one of which contacts is electrically connected at all times to said second common line-terminal means, first and second independently-operable actuating means for selectively actuating either the first or the second air-break switch means for thereby moving the respective movable conducting member thereof of the particular selected air-break switch to electrically interconnect the respective first and second line-terminals, said operating mechanism of the load-break switch being responsive to actuation of either of the first or second selected independently-operable actuating means, an auxiliary stationary terminal associated with said load-break switch and electrically connected at all times to the other separable contact of the load-break switch, the first and second independently-operable actuating means functioning to first cause electrical interengagement between the movable conducting member of the respective selected air-break switch with said auxiliary stationary terminal and quick-break closure of the separable contacts of the load-break switch means and a subsequent opening of said separable contacts of the load-break switch means following a subsequent electrical disengagement of the respective movable conducting member from the auxiliary terminal during the closing operation, and interlocking means to prevent the actuation of both the first and second actuating means of the two air-break switch means at the same time.

44. In combination, first and second air-break switch-means (20, 21), each of said first and second air-break switch-means having its own individual first line-terminal, means defining a second spaced line-terminal common to both of said first and second switch-means, means defining a load-break switch-means generally interposed between said first and second air-break switch-means and having a pair of separable contacts, one of said separable contacts being connected at all times to said common second line-terminal, means defining an auxiliary stationary terminal associated with said load-break switch-means, an operating means for actuating the separable contacts of said load-break switch-means to effect thereby opening and closing of the separable contacts of said load-break switch-means, each of said first and second air-break switch-means having its own individual movable conducting member making, at times, engagement and disengagement with said second common line-terminal, said stationary auxiliary terminal of the load-break switch-means being interposed in the path of movement of each of the two movable conducting members of the first and second air-break switch-means, interlocking means preventing simultaneous operation of both of the movable conducting members at the same time, first and second actuating means for operating the movable conducting member of the first and second air-break switching-means so that each air-break switching-means has its own individual independent actuating means isolated and independent of the actuating means for the other adjoining air-break switching-means, said operating means of the load-break switching-means being responsive to the movement of both the first and second actuating means, whereby selective operation of either one of the two actuating means will concomitantly effect operation of the operating means for the load-break switch-means, whereby during the closing operation of each of the selected first and second air-break switching-means there first occurs a contacting electrical engagement between the respective movable conducting member and said auxiliary stationary terminal together with actuation of the operating means for closing of said separable contacts of the load-break switch-means following engagement of the movable conducting member with the auxiliary stationary terminal, and means effecting an opening movement of said separable contacts following a disengagement of the movable conducting member away from said auxiliary stationary terminal during such a closing operation and subsequent to the electrical engagement between said movable conducting member and said second common line-terminal, and during the opening operation said particular actuating means functioning to effect a closing and a later opening movement of said separable contacts of the load-break switching-means following a disengagement of the respective movable conducting member away from the said common second line-terminal and following its temporary contacting engagement with said auxiliary stationary terminal, whereby said load-break switching-means may be used commonly for the operation of either of said first and second air-break switching-means.

45. The combination according to claim 44, wherein the movable cnducting member is generally of blade configuration and moves in a generally circular path.

46. The combination according to claim 45, wherein the auxiliary stationary terminal makes sliding contacting engagement with said movable blade member.

47. The combination according to claim 46, wherein the load-break switching-means comprises a vacuum bottle having the separable contacts in an evacuated environment.

* * * * *